US009493983B2

(12) United States Patent
Zhang et al.

(10) Patent No.: US 9,493,983 B2
(45) Date of Patent: Nov. 15, 2016

(54) LOUVER ROLLER SYSTEM WITH CAM PIN TURNING MECHANISM

(71) Applicant: HANGZHOU WOKASOLAR TECHNOLOGY CO., LTD., Hangzhou, Zhejiang (CN)

(72) Inventors: Yifei Zhang, Hangzhou (CN); Chengshang Wu, Hangzhou (CN); Gang Gui, Hangzhou (CN); Huiwen Xu, Hangzhou (CN)

(73) Assignee: HANGZHOU WOKASOLAR TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 14/418,454

(22) PCT Filed: Jul. 28, 2013

(86) PCT No.: PCT/CN2013/080259
§ 371 (c)(1),
(2) Date: Jan. 30, 2015

(87) PCT Pub. No.: WO2014/019482
PCT Pub. Date: Feb. 6, 2014

(65) Prior Publication Data

US 2015/0184457 A1 Jul. 2, 2015

(30) Foreign Application Priority Data

Jul. 30, 2012 (CN) ..... 2012 1 0268529

(51) Int. Cl.
*E06B 9/308* (2006.01)
*E06B 9/56* (2006.01)
*E06B 9/322* (2006.01)

(Continued)

(52) U.S. Cl.
CPC ..... *E06B 9/56* (2013.01); *E06B 9/308* (2013.01); *E06B 9/322* (2013.01); *E06B 9/386* (2013.01); *E06B 9/44* (2013.01)

(58) Field of Classification Search
CPC ..... E06B 9/308; E06B 9/30; E06B 9/322; E06B 2009/2452
USPC ..... 160/115
See application file for complete search history.

(56) References Cited

U.S. PATENT DOCUMENTS 6,076,587 A * 6/2000 Pastor ..... E06B 9/307 160/115
6,845,802 B1 * 1/2005 Anderson ..... E06B 9/307 160/115

(Continued)

FOREIGN PATENT DOCUMENTS

CN 2525230 Y 12/2002
CN 2727374 Y 9/2005

(Continued)

*Primary Examiner* — David Purol
(74) *Attorney, Agent, or Firm* — Wayne & King LLC

(57) ABSTRACT

The invention discloses a louver roller system with a cam pin turning mechanism, including a base and a top cover, wherein a roller mechanism and a cam pin turning mechanism are mounted on the base, the roller mechanism is wound with ladder tapes, the roller mechanism is in axial connection with the cam pin turning mechanism, and the roller mechanism and the cam pin turning mechanism are driven to rotate by a square shaft. The roller mechanism controls horizontal rising and falling of secondary louver blades, and the roller within the roller mechanism rotates to wind or unwind the ladder tapes thereon and sequentially drives various secondary louver blades to rise and fall horizontally. When various secondary louver blades rise to a predetermined position, the roller drives the cam pin turning mechanism to bring a turning cylinder to rotate, so as to achieve turning of all louver blades.

14 Claims, 23 Drawing Sheets

(51) Int. Cl.
*E06B 9/44* (2006.01)
*E06B 9/386* (2006.01)

(56) References Cited

U.S. PATENT DOCUMENTS 7,913,738 B2 * 3/2011 Fraser ..... E06B 9/322
160/115
2010/0186907 A1 * 7/2010 Kraler ..... E06B 9/322
160/176.1 P

FOREIGN PATENT DOCUMENTS

CN 1795317 A 6/2006
CN 101818616 A 9/2010
CN 102071871 A 5/2011

* cited by examiner

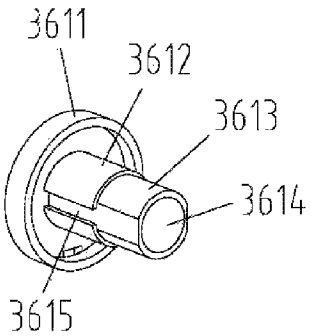
Fig.29a
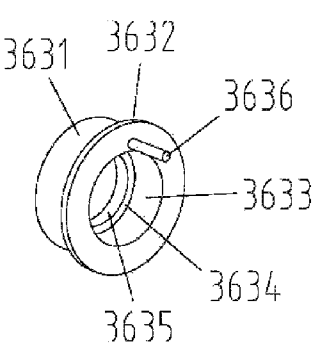
Fig.30a
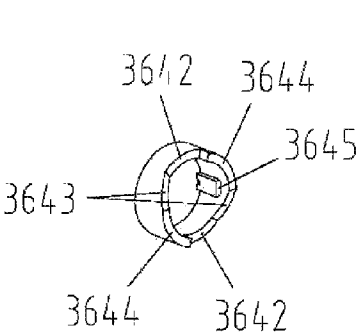
Fig.31a
Fig.29b
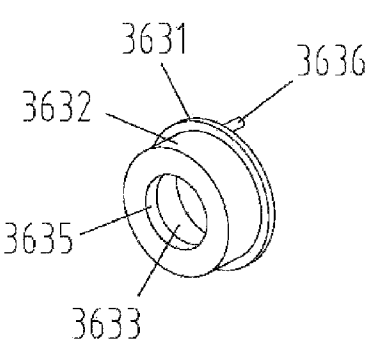
Fig.30b
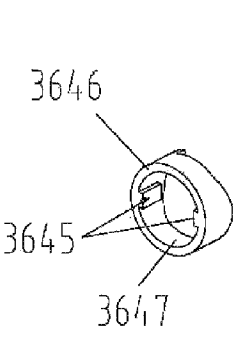
Fig.31b

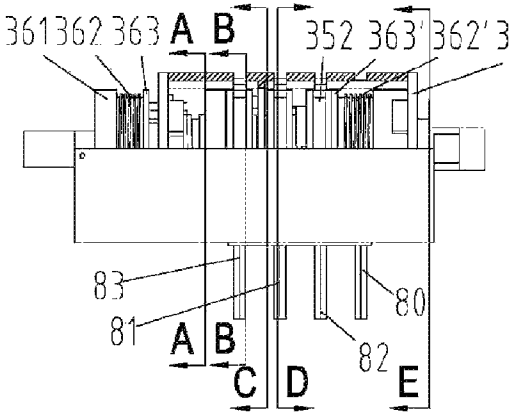
Fig.43
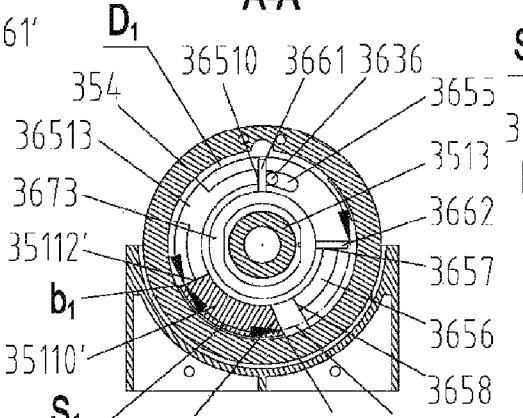
Fig.44a
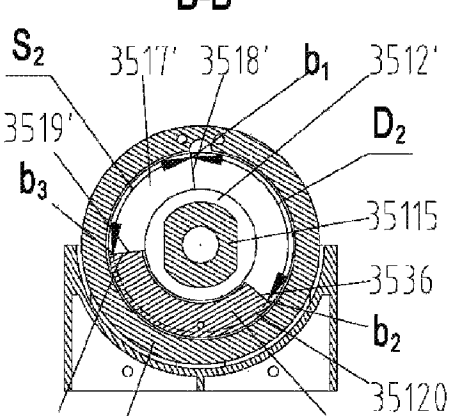
Fig.44b
Fig.44e
Fig.44c
Fig.44d

LOUVER ROLLER SYSTEM WITH CAM PIN TURNING MECHANISM

FIELD OF THE INVENTION

The invention relates to a louver, in particular to a louver roller system.

BACKGROUND

Conventional louver consists of louver blades with arch-up cross sections, halyards, ladder tapes, a top rail and a base tail. A rotary actuator with self-locking function, a rotating shaft, several winding halyards and rollers for controlling the ladder tapes are installed in the top rail, the rotating shaft passes through the rotary actuator and the roller, there are ladder tapes between the top rail and the base rail, the lower ends of the ladder tapes are in fixed connection with the base rail, and two upper ends of the ladder tapes are butted and sheathed on the roller; a plurality of louver blades in parallel are put in the breast line of the ladder tape, a through hole is set at a symmetric center of the cross section of the louver blade to allow the halyard to pass through, the lower end of the halyard is in fixed connection with the base rail, and the upper end of the halyard is wound on the roller; the rotating shaft and the roller are driven to rotate by the rotary actuator, thus the louver blades can be lifted and turned over; when the louver blades are folded, the halyards are wound to drive the base rail to rise, thus sequentially lifting up and folding the louver blades, and when the louver blades are unfolded, the halyards are unwound, and under the gravity of the base rail, the louver blades move down sequentially and are placed at an equal distance separated by the breast line of the ladder tape; when the base rail reaches the windowsill, the halyards are unwound completely, and when the rotary actuator continues to be pulled, the roller rotating together with the rotating shaft will turn the louver blades over under the action of frictional force, thus achieving the effect of adjusting indoor light. In practice, the roller for winding the halyards can also be replaced by a screw (see Utility Model ZL 02201583.3, Utility Model ZL 200420078400.6 and Patent Application No.: 200480014523.6), and the roller which drives the ladder tapes to rotate by virtue of frictional force or bayonets can also be replaced by a torsion spring or a snap spring wheel (see Patent Application No.: 200480014523.6).

One of critical defects of the conventional louver is that indoor daylight illumination could not be uniform. If the louver blades are turned over and adjusted until the light near the window is moderate and glareless, the light deep into the interior is not enough, and it requires artificial lighting. If the louver blades are turned over and adjusted until the light deep into the interior is moderate, the light near the window is glare. In addition, people only need moderate light, but no heat in summer, and people need both moderate light and heat in winter, however, for the purpose of reducing light and heat near the window, the louver blades of the conventional louver must be turned to the extent that the louver are almost closed whether in summer or in winter, which results in that the whole room is too dark, and appropriate indoor illumination should be maintained by artificial lighting whether in sunny day or cloudy day, thus causing enormous energy wastage and also reducing people's comfort and work efficiency. Therefore, in order to prevent glare and overheating near the window and give uniform daylight illumination deep into the interior, Chinese Patent Application (Application No.: 201010162501.1 and Application No.: 2010 1062 0508.3) discloses two combinatorial louver blades which can change space between louver blades, a combinatorial louver composed of such combinatorial louver blades would not change the path of light irradiating to the louver blades no matter whether the sun altitude H is greater or less than the shading angle of the louver, thus it can not only meet the requirement for preventing glare and overheating near the window, but also meet the requirement for uniform daylight illumination deep into the interior. Meanwhile, visual communication and air flow indoor and outdoor will not be affected. However, this patent application only disclosed the combinatorial structure of the combinatorial louver blades as well as shading and light guiding effects of relatively lifting and turning over the louver blade, and did not disclose a driving mechanism associated with such combinatorial louver.

Therefore, in order to solve above problems, the invention discloses a roller system suitable for the above-mentioned combinatorial louver, and this roller system is also applicable to a pitch-variable combinatorial louver comprising more than three secondary louver blades of the above inventions.

The pitch D referred to in the invention is the distance between two adjacent primary louver blades, the width L of the louver blade is the horizontal width of the cross section of the louver blade, the pitch ratio D/L is the ratio of the pitch D of the louver to the width L of the louver blade, $D_1$ is the vertical distance of a first secondary louver blade relative to a lower primary louver blade of two adjacent primary louver blades, $D_2$ is the vertical distance of a second secondary louver blade relative to a lower primary louver blade of two adjacent primary louver blades, $D_3$ is the vertical distance of a third secondary louver blade relative to a lower primary louver blade of two adjacent primary louver blades, and $\phi$ is a turning closed angle that the louver blade is deviated from a horizontal position.

SUMMARY OF THE INVENTION

Because no driving mechanism of such combinatorial louver exists in the prior art, for accomplishing above actions of the louver blades, the invention discloses a roller mechanism for accomplishing above actions of the louver, which is mainly used for controlling rising and falling of the secondary louver blades and turning of all louver blades.

In order to solve above technical problems, the invention solves by the following technical solutions:

A louver roller system with a cam pin turning mechanism comprises a base and a top cover. A roller mechanism and a cam pin turning mechanism are mounted on the base, the roller mechanism is wound with ladder tapes, the roller mechanism is in axial connection with the cam pin turning mechanism, and the roller mechanism and the cam pin turning mechanism are driven to rotate by a square shaft, the roller mechanism controls horizontal rising and falling of secondary louver blades, there is a roller set within the roller mechanism, the roller is wound with ladder tapes, the ladder tapes are connected with louver blades, the roller drives ladder tapes thereon to wind while rotating, so as to achieve horizontal rising or falling of various secondary louver blades, and when various secondary louver blades rise to a predetermined position, the cam pin turning mechanism achieves turning of all louver blades.

Preferably, a cam pin turning mechanism is axially mounted at the side of the roller mechanism, the roller mechanism comprises a turning cylinder, at least one roller is mounted within the turning cylinder, a turning disc of the cam pin turning mechanism is cooperatively mounted on an open end surface of the turning cylinder, there is a torsion spring set within one end of the turning disc, and the torsion spring is sheathed on a torsion spring jacket, the torsion spring jacket is adjacent to the roller, a fixed sleeve is cooperatively mounted on the other end of the turning disc, and a compression spring (362), a pin disc and a sliding cam are axially and sequentially set between the fixed sleeve and the turning disc. The roller rotates to press the torsion spring, the torsion spring press the turning disc not to rotate, the cam at the side of the turning disc is cooperated with the sliding cam, to make the sliding cam move axially, the sliding cam and the compression spring act on the pin disc simultaneously to make the pin disc move left and right, then the pin on the pin disc will pass through or leave away from the pin hole on the turning disc. Locking and unlocking of the turning disc are achieved. A group of cam pin turning mechanisms are axially set at the side of the roller mechanism, for achieving regulation of rising an equal pitch of the secondary louver blades in turn within one pitch.

Preferably, a set of cam pin turning mechanism is each mounted on both axial sides of the roller mechanism, the roller mechanism comprises a turning cylinder, a first secondary roller is mounted within the turning cylinder, a third secondary roller, a split wheel (351'), a torsion spring jacket, a torsion spring, a turning disc, a sliding cam, a pin disc, a compression spring and a fixed sleeve are sequentially and axially mounted on one side of the first secondary roller, and a torsion spring jacket, a torsion spring, a turning disc, a sliding cam, a pin disc, a compression spring and a fixed sleeve are sequentially and axially mounted on the other side of the first secondary roller, after the first secondary roller, the split wheel and the turning disc rotate synchronously to drive a first secondary louver blade and a second secondary louver blade to rise a certain distance $D_2$ synchronously and horizontally, the turning disc is detached from the first secondary roller through the cam pin turning mechanism, then the first secondary roller drives the third secondary roller to rotate, making the first secondary louver blade and the third secondary louver blade rise synchronously and horizontally, and after rising $D_3$, the turning disc and the turning cylinder are driven to rotate by the cam pin turning mechanism.

Preferably, the turning cylinder is a circular cylinder of which one end is a closed end surface and the other end is an open end surface, annular grooves are set on an outer ring surface of the turning cylinder, a hole is set on the top of each of the annular grooves and pin shafts are mounted on both sides of the holes, sector bulges are axially held out from an outer wall of the closed end surface of the turning cylinder, for controlling rotation angle of the turning cylinder, when turning cylinder rotates to its sector bulges and touches a base bulge, it does not continue to rotate any more and when the turning cylinder rotates reversely, an annular bulge axially held out from an inner wall of the closed end surface of the turning cylinder acts on a second secondary roller, such that the second secondary roller rotates reversely to drive the second secondary louver blade to return to a horizontal position. The annular grooves are respectively wound by ladder tapes, and the ladder tapes pass through the pin shaft, are hung down and connected with the blades. The holes on the top and the pin shafts inserted into the pin holes facilitate reducing the frictional force between cords of the ladder tapes and the turning cylinder after upper ends of the front and rear cords of the first secondary ladder tape, the second secondary ladder tape and the third secondary ladder tape. The sector bulge axially held out from the outer wall of the closed end surface of the turning cylinder is used for controlling the rotation angle of the turning cylinder, and when it rotates to a predetermined position, the sector bulge touches and propped against the base, such that it can not continue to rotate. When the turning cylinder rotates reversely, the annular bulge axially held out from the inner wall of the closed end surface of the turning cylinder acts on the second secondary roller, to make the second secondary roller rotate reversely and drive the second secondary louver blade to return to the horizontal position. One side of the annular disc of the turning disc is a plane and a pair of symmetric annular cams on the top and transition bevel are set thereon, and a convex-shaped annular step is on the end of other side of the annular disc. A high arc wall and a low arc wall are formed by cutting off a θ angle portion from an annular wall, wherein the high arc wall has an end wall, the low arc wall has an end wall, and the junction of the two walls is such that a pin hole is set near the end wall of the low arc wall. The angle between both ends of the torsion spring is θ, and this angle is dependent on two factors: the angle required when the first secondary roller drives the first secondary louver blade to rise to the maximum height $D_1$ relative to the primary louver blade, and the arc length for ensuring that the high arc wall of the turning disc has enough strength. One end of the torsion spring is placed on the end wall of the low arc wall of the turning disc, and the other end of the torsion spring is placed on the end wall of the high arc wall of the turning disc, so as to lock the turning disc on the fixed sleeve of the roller mechanism.

Preferably, the turning cylinder is a circular cylinder, there is a partition wall set within the turning cylinder and annular grooves set on its outer ring surface, a hole is set on the top of each of the annular grooves and pin shafts are mounted on both sides of the holes, a hole is set on the top of the annular groove for fixing the pin shaft, the partition wall of the turning cylinder is set with an inner ring and a sector inner hole, and when the turning cylinder rotates reversely, it acts on the third secondary roller (353), such that the third secondary roller (353) rotates reversely to drive the third secondary louver blade to return to a horizontal position. The turning cylinder is a circular cylinder, on its outer ring surface, there are annular grooves for embedding the secondary ladder tapes and an annular groove for embedding the primary ladder tape, a hole is set on the top of each of the annular grooves and pin shafts are mounted on both sides of the holes, so as to reduce frictional force between the cords of the ladder tapes and the turning cylinder after the upper ends of the front and rear cords of the secondary ladder tapes go in. Two upper ends of the primary ladder tape are directly fixed on the pin shaft, an inner ring partition wall is set within the turning cylinder, a sector hole is set thereon, one end of the turning cylinder is set with bayonets and a pin hole for holding semi-circular notch across the inner wall of the turning cylinder for assembling upper ends of the secondary ladder tape and inserting the pin shaft, and the other end of the turning cylinder is set with bayonets and a pin hole for inserting the pin shaft.

Preferably, the first secondary roller comprises an annular disc and a hollow shaft, an annular groove is set in the center of the annular disc, and sector bulges are axially set on both sides of the annular disc. Six square shafts pass through the hollow shaft, and the six square shafts drive the hollow shaft to rotate. The annular grooves are wound by the cords of the ladder tapes inside, and the sector bulges axially set on both sides are jogged with the turning disc and the second secondary roller. When the sector bulges of two adjacent structures are touched, they are driven by each other.

Preferably, the second secondary roller comprises an annular disc, an annular groove is set on the annular disc, a sector bulge is axially held out from one side of the annular disc adjacent to the first secondary roller, and an annular convex platform with a sector bulge is axially held out from the other side of the annular disc. The first secondary roller and the second secondary roller are mounted within the turning cylinder, the first secondary roller is driven to rotate by the square shaft, the sector bulge at the side of the first secondary roller is pressed against the sector bulge at the side of the second secondary roller, and then drives the second secondary roller to rotate. The first secondary roller and the second secondary roller control rising and falling of the secondary louver blade and the second secondary louver blade respectively, and when the first secondary roller rotates, the first secondary ladder tape connected is wound on, and the secondary louver blade rises. When it rises to a predetermined position, it drives the second secondary roller to rotate, the second secondary ladder tape connected is wound on, and the second secondary louver blade rises. When it rises to a predetermined position, it drives the turning cylinder to rotate, so as to achieve turning of all blades. Similarly, a third secondary roller can be added. The rollers required to be controlled can be determined according to the number of ladder tapes.

Preferably, the third secondary roller comprises an annular disc, an annular groove is set on the annular disc, a sector bulge is axially held out from one side of the annular disc adjacent to the first secondary roller, and an annular convex platform with a sector bulge is axially held out from the other side of the annular disc.

Preferably, an annular concave disc is set on one side of the turning disc, a high arc wall and a low arc wall which are step-like are set in the annular concave disc, a pin hole is set near an end wall of the low arc wall, a torsion spring is mounted inside of the high arc wall and the low arc wall, both ends of the torsion spring are set on the end walls of the high arc wall and the low arc wall, a convex platform with a transition bevel is set on the other side of the turning disc, and the convex platform is matched with the sliding cam.

Preferably, an annular concave disc is set on one side of the turning disc, a high arc wall and a low arc wall which are step-like are set in the annular concave disc, a pin hole is set near an end wall of the low arc wall, a torsion spring is mounted inside of the high arc wall and the low arc wall, both ends of the torsion spring are set on the end walls of the high arc wall and the low arc wall, a convex platform with a transition bevel is set on the other side of the turning disc, the convex platform is matched with the sliding cam, and an annular groove is set in the outer ring of the turning disc.

Preferably, a pin is set on the pin disc, a sliding cam is set within the pin disc, and a compression spring is mounted between the pin disc and the fixed sleeve.

Preferably, a pair of raised keys are set on an inner ring wall of the annular disc of the sliding cam, a bulge and a transition bevel are set on the side of the sliding cam, and the bulge and the transition bevel are matched with the convex platform of the turning disc. The outer ring diameter of the sliding cam is equal to the outer ring diameter of the inner ring step of the pin disc, such that the bottom of the sliding cam is always kept in the state of touching the bottom of the inner ring step of the pin disc with the action of the compression spring.

The roller system for the above-mentioned louver according to the technical solutions of the invention can control relative lifting of the secondary louver blades and turning of all louver blades.

BRIEF DESCRIPTION OF THE DRAWINGS

FIG. 29 is a three-dimensional diagram of the fixed sleeve I of the cam pin turning mechanism of the roller system with three secondary louver blades (dual binary pitch).

FIG. 30 is a three-dimensional diagram of the pin disc of the cam pin turning mechanism of the roller system with three secondary louver blades (dual binary pitch).

FIG. 31 is a three-dimensional diagram of the sliding cam of the cam pin turning mechanism of the roller system with three secondary louver blades (dual binary pitch).

FIG. 43 is the front view and the schematic diagram of profile positions of the roller system with three secondary louver blades (dual binary pitch).

FIG. 44*a* is an A-A sectional view of the roller system with three secondary louver blades (dual binary pitch).

FIG. 44*b* is a B-B sectional view of the roller system with three secondary louver blades (dual binary pitch).

FIG. 44*c* is a C-C sectional view of the roller system with three secondary louver blades (dual binary pitch).

FIG. 44*d* is a D-D sectional view of the roller system with three secondary louver blades (dual binary pitch).

FIG. 44*e* is an E-E sectional view of the roller system with three secondary louver blades (dual binary pitch).

DETAILED DESCRIPTION OF PREFERRED EMBODIMENTS

Figure 1:
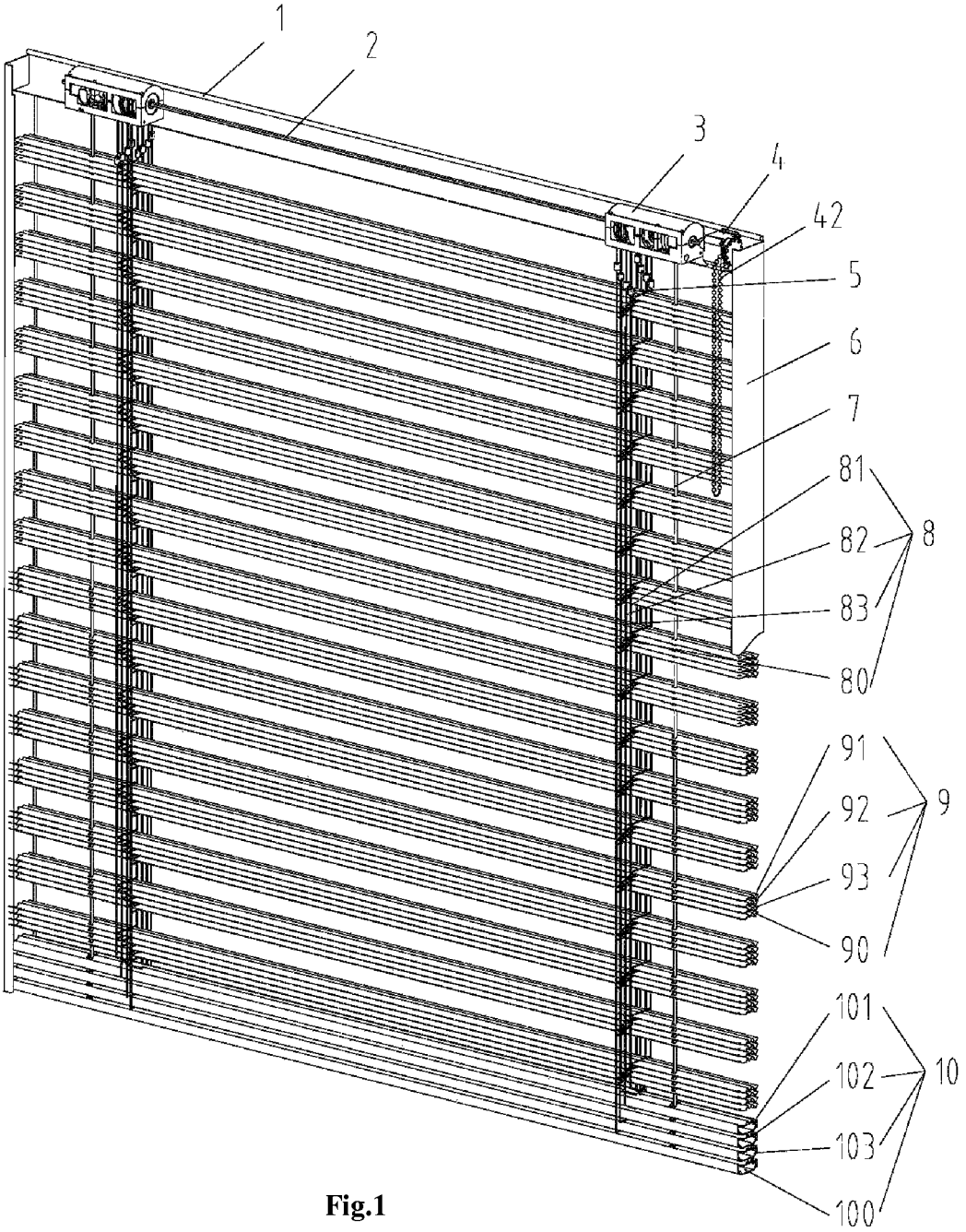
FIG. 1 is a three-dimensional diagram of a pitch-variable combinatorial louver with three secondary louver blades.

The invention will be further described in detail in conjunction with the FIGS. 1-50 and specific embodiments, below:

FIG. 1 shows a pitch-variable combinatorial louver with three secondary louver blades (from the inside out), comprising a top rail 1, six square shafts 2, a roller system 3, an actuator 4, a cord connector 5, a side rail 6, a halyard 7, a ladder tape group 8, a louver blade group 9 and a base rail group 10; taking the pitch-variable combinatorial louver with three secondary louver blades as an example, the ladder tape group 8 comprises the primary and secondary ladder tapes 8X (the primary ladder tape 80, the first secondary ladder tape 81, the second secondary ladder tape 82 and the third secondary ladder tape 83); the louver blade group 9 comprises the primary and secondary louver blades 9X (the primary louver blade 90, the first secondary louver blade 91, the second secondary louver blade 92 and the third secondary louver blade 93); and the base rail group 10 comprises the primary and secondary base rail 10X (the primary base rail 100, the first secondary base rail 101, the second secondary base rail 102 and the third secondary base rail 103); the actuator 4 and the roller system 3 are placed in the top rail 1, generally the actuator 4 is placed on the right end of the top rail 1, and the louver usually needs two roller systems 3; six square shafts 2 pass through the actuator 4 and the roller system 3 to connect the both together, and if a bead chain 42 on the actuator 4 is pulled, six square shafts 2 can be rotated by the actuator 4, so as to rotate the roller system 3 to rotate. The halyard 7 passes through the louver blade group 9, its upper end is connected with the lifting wheel 33 in the roller system 3, and its lower end is connected with the primary base rail 100; and upper ends of the front and rear cords 8X1 and 8X2 of the secondary ladder tapes 8X pass through a ladder tape hole 384 (see FIG. 4) of the base 38 of the roller system 3 and are embedded in annular grooves 3541 and 3542 of the turning cylinder 354 of the roller mechanism 35 of the roller system 3, then go into a hole 3545 on its top and are connected with the secondary roller 35X (the first secondary roller 351, the second secondary roller 3512 and the third secondary roller 353). The primary and secondary louver blades 9X are pulled into the space between the upper and lower breast lines 8X11 and 8X12 of the primary and secondary ladder tapes 8X, both lower ends of the front and rear cords 8X1 and 8X2 of the primary and secondary ladder tapes 8X are fixed on the primary and secondary base rail 10X, and when the primary louver blade 90 and the secondary louver blades 9X turn over together (see FIG. 45-47), upper ends of the front and rear cords 801 and 802 of the primary ladder tape 80 are fixed on the pin shaft 3546 of the annular groove 3544 of the turning cylinder 354 of the roller system 3 (see FIGS. 7*a* and 38*a*), and when the primary louver blade 90 does not turn over, but the secondary louver blades 9X turn over (see FIG. 48-50), the upper ends of its front and rear cords 801 and 802 are directly connected with the top rail 1; the order in which the louver blades of the louver blade group are superposed is as follows: the first secondary louver blade 91 is on the top, the second secondary louver blade 92 is below the first secondary louver blade 91, the third secondary louver blade 93 is below the second secondary louver blade 92, and the primary louver blade is on the bottom; the order in which the base rails of the base rail group are superposed is as follows: the first secondary base rail 101 is on the top, the second secondary base rail 102 is below the first secondary base rail 101, the third secondary base rail 103 is below the second secondary base rail 102, and the primary base rail is on the bottom; the side rail 6 is placed on two ends of the blade group 9 and the base rail group 10, two ends of the blade group 9 and the base rail group 10 extend into a groove of the side rail 6 and can slide up and down, to avoid wind shaking of the blade group 9 and the base rail group 10; the critical component of the driving mechanism of the pitch-variable combinatorial louver is the roller system for controlling relative lifting of the secondary louver blades and turning of all blades.

Example 1

Turning Cylinder with One Roller Mounted Therein, a Structure with One Secondary Louver Blade A movement cycle of relative lifting and turning of combinatorial louver blades of the pitch-variable combinatorial louver with one secondary louver blade is as follows: (1) the primary louver blade 90 is spread over the louver at an equal space, and the secondary louver blade 91 is superposed on the primary louver blade 90 (corresponding to FIG. 45*a*); (2) the first secondary louver blade 91 rises to the position $D_1$ relative to the primary louver blade 90 (corresponding to FIG. 45*b*); (3) the primary and secondary louver blades 90 and 91 simultaneously rotate $\phi$ from a horizontal position to close the louver (corresponding to FIG. 45*c*); (4) the primary and secondary louver blades 90 and 91 simultaneously turn $\phi$ back to the initial horizontal position (corresponding to FIG. 45*b*); and (5) the first secondary louver blade 91 falls relative to the primary louver blade 90, until it is superposed on the primary louver blade 90 (corresponding to FIG. 45*a*), here D/L is set to be 0.8, and $D_1$=D/2.

Figure 2:
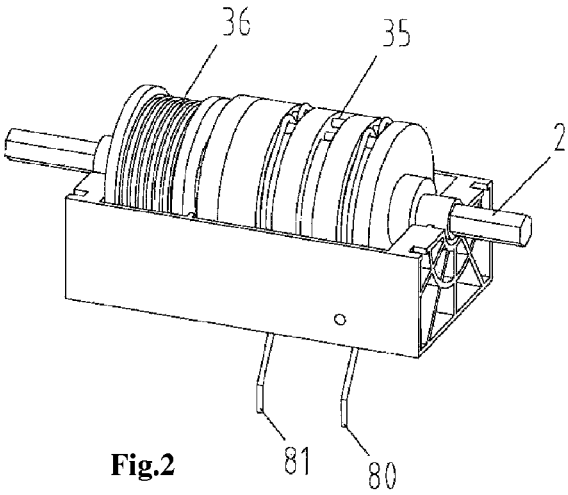
FIG. 2 is a three-dimensional diagram of a roller system 3 of a pitch-variable combinatorial louver with one secondary louver blade.
Figure 3:
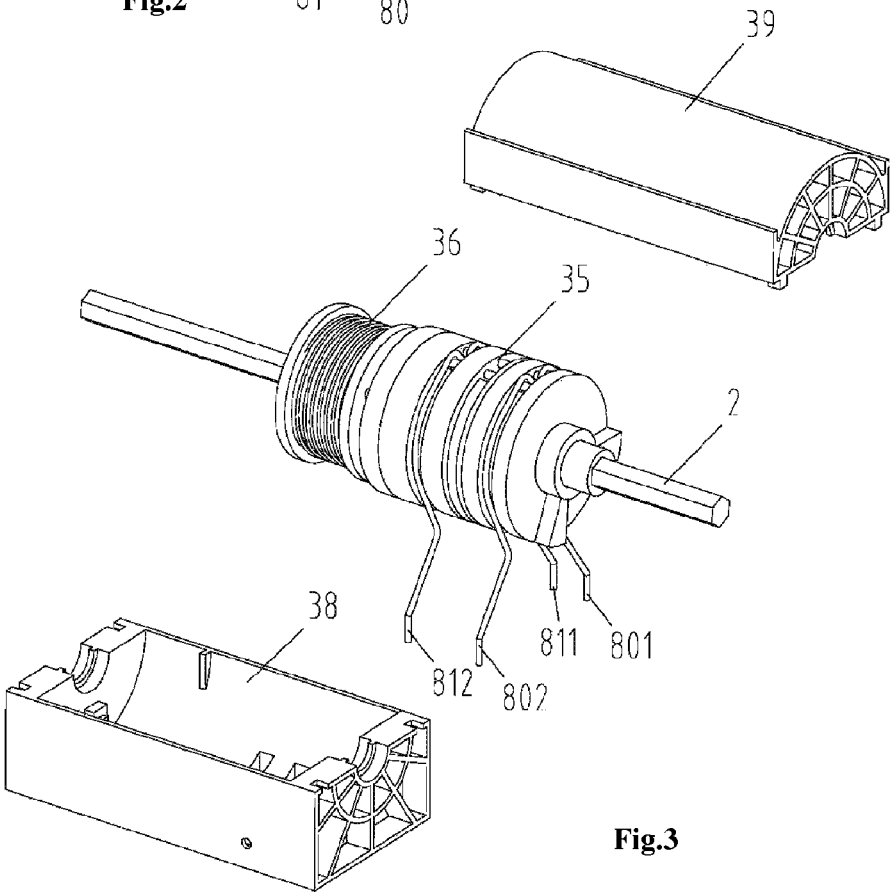
FIG. 3 is a three-dimensional explosive diagram of the roller system 3 of a pitch-variable combinatorial louver with one secondary louver blade.
Figure 4:
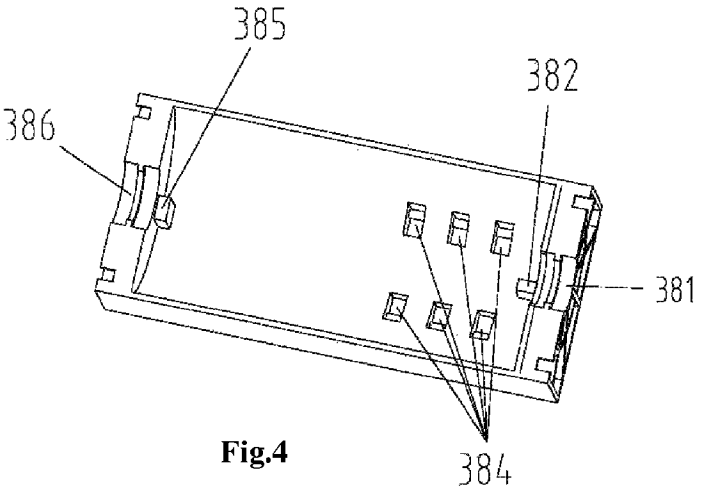
FIG. 4 is a three-dimensional diagram of a base of the roller system with one secondary louver blade.
Figure 5:
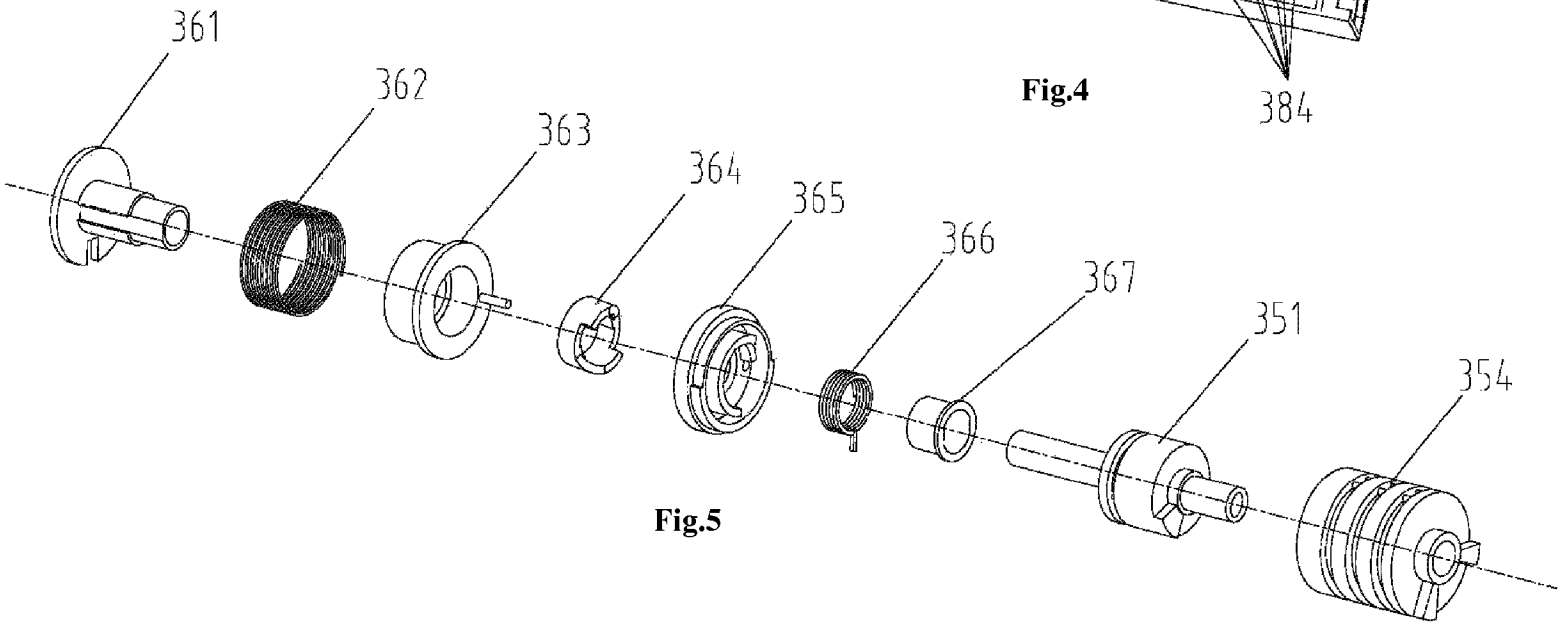
FIG. 5 is a three-dimensional explosive diagram of the roller system with one secondary louver blade.

According to FIGS. 2, 3 and 5, the roller system 3 for the pitch-variable combinatorial louver with one secondary louver blade comprises a roller mechanism 35 and a turning mechanism 36, the roller mechanism 35 comprises a turning cylinder 354 and a first secondary roller 351, the first secondary roller 351 is mounted in the turning cylinder 354, and the cam pin turning mechanism 36 comprises a fixed sleeve 361, a compression spring 362, a pin disc 363, a sliding cam 364, a turning disc 365, a torsion spring 366 and a spring sheath 366 which are axially connected.

Figure 6A:
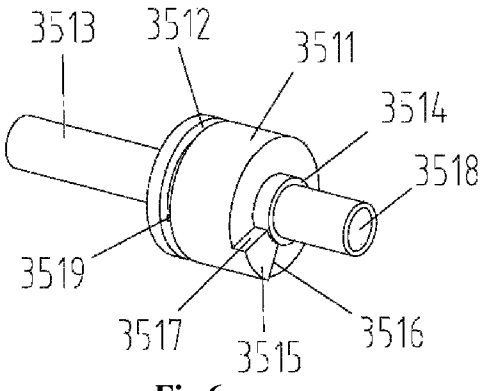
FIG. 6 is a three-dimensional diagram of a first secondary roller of a roller mechanism of the roller system with one secondary louver blade.
Figure 6B:
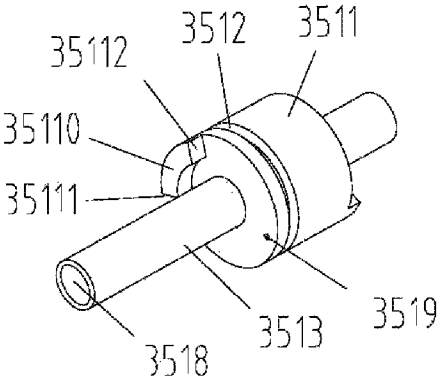

FIG. 6 is a three-dimensional diagram of the first secondary roller 351 of the roller mechanism 35. The first secondary roller 351 is formed by an annular disc 3511 bond as a whole with a hollow shaft 3513 which passes through its inner ring, an annular groove 3512 is set in the outer ring of the annular disc 3511, sector bulges 3515 and 35110 are each axially held out from both sides of the annular disc 3511 an a pin hole 3519 is set for fixing upper ends of the front and rear cords 811 and 812 of the first secondary ladder tape.

Figure 7A:
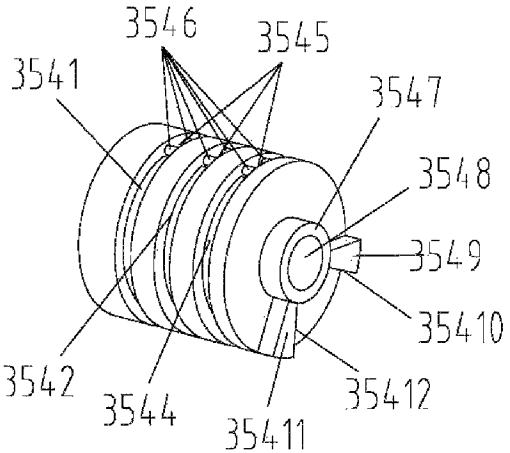
FIG. 7 is a three-dimensional diagram of a turning cylinder of the roller mechanism of the roller system with one secondary louver blade.
Figure 7B:
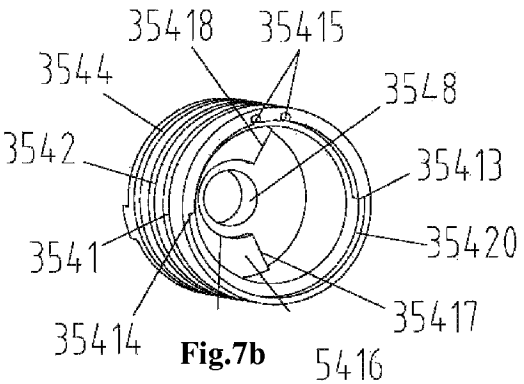

FIG. 7 is a three-dimensional diagram of the turning cylinder 354 of the roller mechanism 35. The turning cylinder 354 is a circular cylinder, annular grooves 3541, 3542 and 3544 are set on its outer ring surface, a hole is set on the top of each of the annular grooves 3541, 3542 and 3544 and pin shafts 3546 are mounted on both sides of the holes to reduce frictional force between the cords of ladder tapes and the turning cylinder 354. Upper ends of the front and rear cords of the first secondary ladder tape 81 pass through the through hole 384 of the base 38 and are embedded in the annular groove 3541, then pass through a hole 3545 between two pin shafts 3546, go into the turning cylinder 354 and get fixed connection with the first secondary roller 351. Two upper ends of the front and rear cords of the primary ladder tape 80 pass through the through hole 384 of the base 38 and are fixed on the pin shaft 3546 around the annular groove 3544, an inner ring 3548 is set on the outer wall of the closed end surface of the turning cylinder 354 and an annular convex platform 3547 connected with two sector bulges 3549 and 35411 are set around the inner ring. A sector bulge 35416 is set on the inner wall of the closed end surface of the turning cylinder 354, the diameter of its inner ring 35419 is equal to the outer diameter of the annular convex platform 3514 of the first secondary roller 351, a concave annular step 35420 jogged with a convex annular step 36511 on the end of the turning disc 365 is set on the open end surface of the turning cylinder 354, and two pin holes 35415 are drilled on the top of the open end surface of the turning cylinder 354, in order to insert the pin shaft 3546.

Figure 8A:
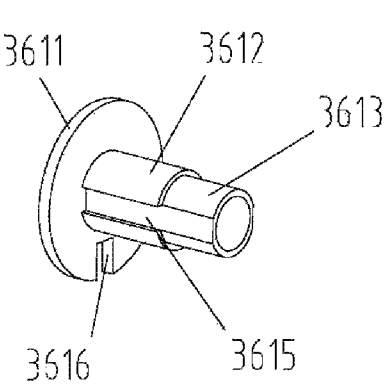
FIG. 8 is a three-dimensional diagram of a fixed sleeve of a cam pin turning mechanism of the roller system with one secondary louver blade.
Figure 8B:
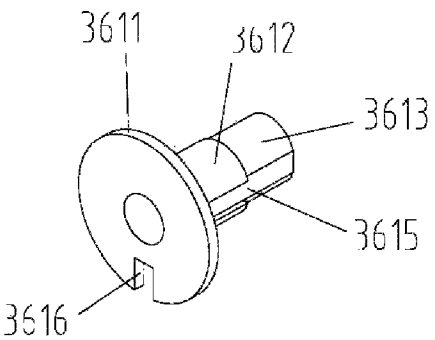

FIG. 8 is a three-dimensional diagram of the fixed sleeve 361 of the cam pin turning mechanism 36. The fixed sleeve 361 is formed by a hollow shaft 3613 combined with an annular disc 3611 as a whole, an annular step 3612 with a pair of symmetric axial notches is set on the hollow shaft 3613, and the axial notch 3615 with a certain depth extends axially, such that the outer ring of the hollow shaft 3613 is cut off two blocks, and there is a notch 3616 on the annular disc 3611.

Figure 9A:
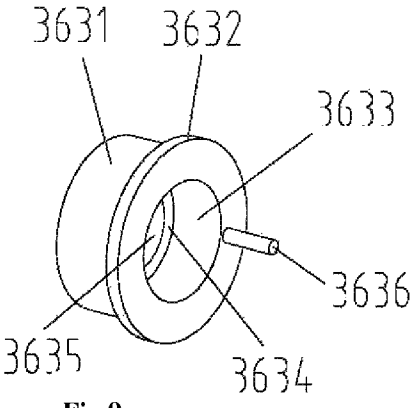
FIG. 9 is a three-dimensional diagram of a pin disc of the cam pin turning mechanism of the roller system with one secondary louver blade.
Figure 9B:
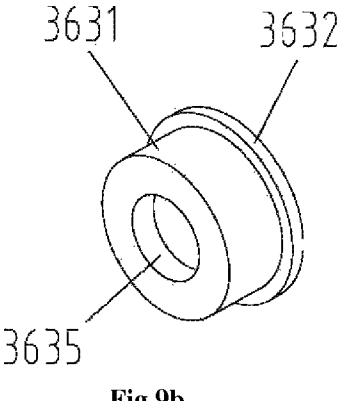

FIG. 9 is a three-dimensional diagram of the pin disc 363 of the cam pin turning mechanism 36. A pin 3636 is set on the annular disc of the pin disc 363, the pin disc 363 comprises an inner ring 3635 and an outer ring 3632, and the inner ring step comprises a bottom 3634 and an outer ring 3633.

Figure 10A:
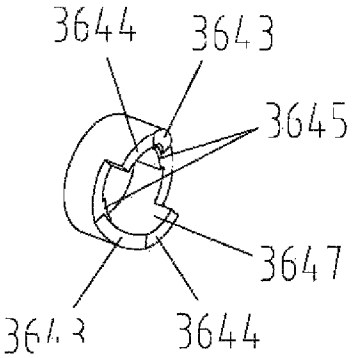
FIG. 10 is a three-dimensional diagram of a sliding cam of the cam pin turning mechanism of the roller system with one secondary louver blade.
Figure 10B:
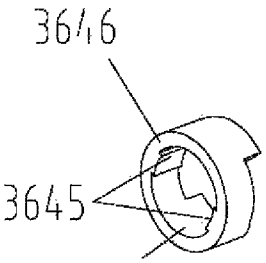

FIG. 10 is a three-dimensional diagram of the sliding cam 364 of the cam pin turning mechanism 36. A raised key 3645 is set on the wall of the inner ring 3647 of the annular disc of the sliding cam 364, one side of the sliding cam 364 is a basal plane 3646, a symmetric convex platform 3644 and a transition bevel 3643 are set on the other side of the sliding cam 364, and the diameter of the outer ring of the sliding cam 364 is equal to the diameter of the outer ring 3633 of the inner ring step of the pin disc 363, such that the bottom of the sliding cam 364 is always kept in contact with the bottom 3634 of the inner ring step of the pin disc 363 under the action of the compression spring 362.

Figure 11A:
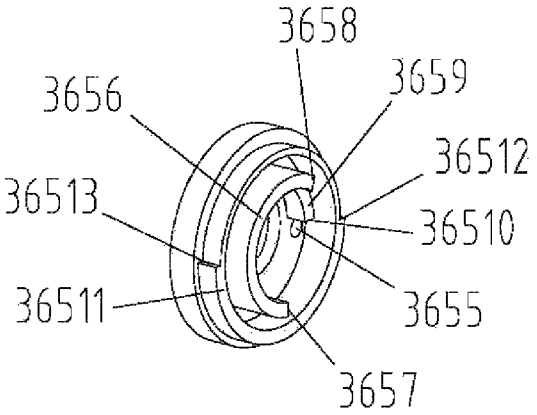
FIG. 11 is a three-dimensional diagram of a turning disc of the cam pin turning mechanism of the roller system with one secondary louver blade.
Figure 11B:
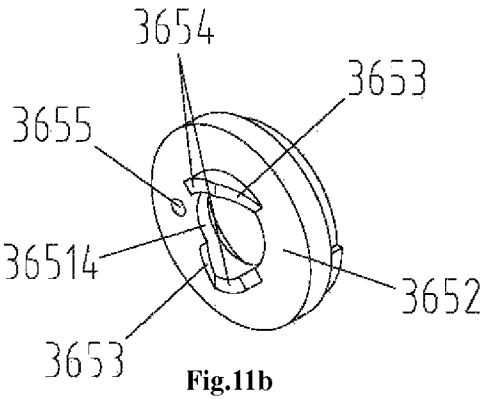

FIG. 11 is a three-dimensional diagram of the turning disc 365 of the roller mechanism 35. The turning disc 365 is an annular disc, one side of the turning disc 365 is a plane 36514, and a pair of symmetric annular cams for the convex platform 3654 and the transition bevel 3653 are set thereon; the end of the other side of the turning disc 365 has a convex-shaped annular step 36511, and a high arc wall 3656 and a low arc wall 3659 which are step-like are set in the concave disc surrounded by it; a high arc wall 3656 and a low arc wall 3659 are formed by cutting off a 0 angle portion from an annular wall, wherein the high arc wall 3656 has an end wall 3657, the low arc wall 3659 includes an end wall 36510 and the junction 3658 of the two walls, and a pin hole 3655 is set near the end wall 36510 of the low arc wall 3659.

Figure 12A:
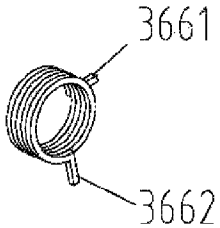
FIG. 12*a* is a three-dimensional diagram of a torsion spring of the cam pin turning mechanism of the roller system with one secondary louver blade.
Figure 12B:
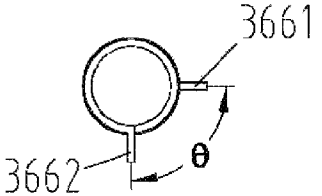
FIG. 12*b* is an axial view of the torsion spring of the cam pin turning mechanism of the roller system with one secondary louver blade.

FIG. 12*a* is a three-dimensional diagram of the torsion spring 366 of the cam pin turning mechanism 36, and FIG. 12*b* is an axial view of the torsion spring 366 of the cam pin turning mechanism 36. The angle between both ends 3661 and 3662 of the torsion spring 366 is θ, and this angle is dependent on two factors: the angle required when the first secondary roller 351 drives the first secondary louver blade 91 to rise to the maximum height $D_1$ relative to the primary louver blade 90, and the arc length for ensuring that the high arc wall 3656 of the turning disc 365 has enough strength. One end 3661 of the torsion spring 366 is placed on the end wall 36510 of the low arc wall 3659 of the turning disc 365, and the other end 3662 of the torsion spring 366 is placed on the end wall 3657 of the high arc wall 3656 of the turning disc 365, so as to lock the turning disc 365 on the fixed sleeve 361 of the roller mechanism 36.

Figure 13A:
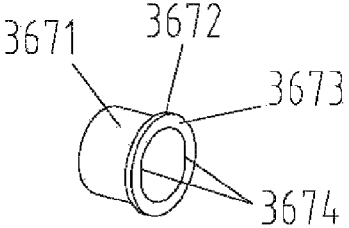
FIG. 13 is a three-dimensional diagram of a sliding cam of the cam pin turning mechanism of the roller system with one secondary louver blade.
Figure 13B:
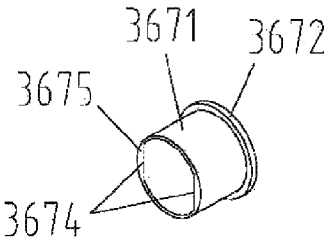

FIG. 13 is a three-dimensional diagram of the torsion spring jacket 367 of the cam pin turning mechanism 36. An annular step 3672 is set on the annular disc 3671 of the torsion spring jacket 367, its outer ring diameter is equal to the diameter of the annular step 3612 of the hollow shaft 3613 of the fixed sleeve 361, and a pair of planar walls 3674 are set in the inner ring of both ends 3673 and 3675 of the torsion spring jacket 367, such that the inner ring of the torsion spring jacket 367 is jogged with the outer ring of the hollow shaft 3613 of the fixed sleeve 361 not to rotate, and the annular step 3672 of the torsion spring jacket 367 prevents the torsion spring 366 from falling off from the torsion spring jacket 367.

Figure 14A:
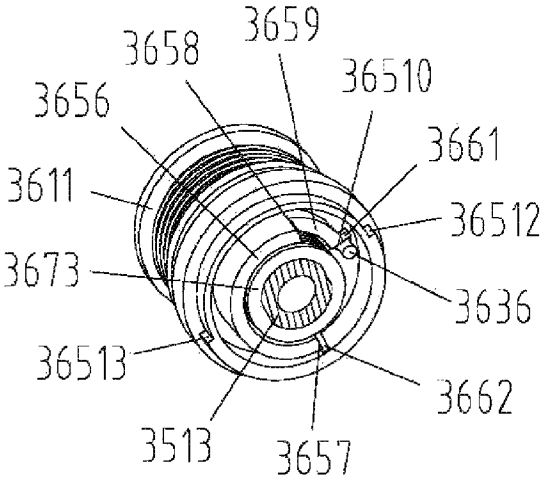
FIG. 14 is a three-dimensional assembly drawing of the cam pin turning mechanism of the roller system with one secondary louver blade.
Figure 14B:
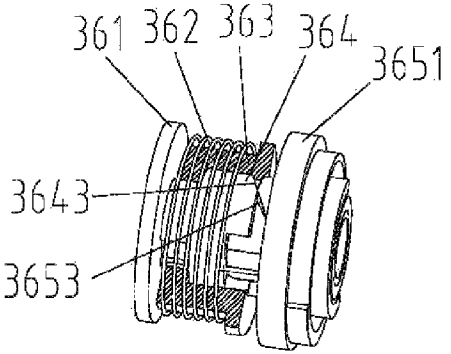

FIG. 14*a* shows the assembly drawing of the cam pin turning mechanism 36, and FIG. 16*b* is the part sectioned view of assembly of the cam pin turning mechanism 36. The bottom surface 3646 of the sliding cam 364 of the cam pin turning mechanism 36 is directed to the bottom surface 3634 of the inner annular groove 3633 of the pin disc 363 and is mounted therein, the compression spring 362 is mounted into the outer ring of the annular disc 3631 of the pin disc 363, then the inner raised key 3645 of the sliding cam 364 is directed to the symmetric notches 3615 on the annular step 3612 of the hollow shaft 3613 of the fixed sleeve 361 and mounted therein together with the pin disc 363, finally the hollow shaft 3613 of the fixed sleeve 361 is inserted into the inner ring 36514 of the turning disc 365 and extended to the position flush with the top of the high arc wall 3656 of the turning disc 365, and meanwhile the annular disc 3611 of the fixed sleeve 361 constrains the compression spring 362, to make it produce pressure on the pin disc 363. The pin 3636 of the pin disc 363 is inserted into the pin hole 3655 of the turning disc 365 and can axially slide, and its head at the initial position is beyond the top of the low arc wall 3659 of the turning cylinder 365. After the torsion spring 366 is sheathed on the torsion spring jacket 367, the torsion spring jacket 367 is mounted on the hollow shaft 3613 of the fixed sleeve 361 and embedded into an annular cavity formed by the hollow shaft 3611 of the fixed sleeve 361 and the high and low arc walls 3656 and 3659 of the turning disc 365, such that the annular step of the torsion spring jacket 367 is aligned with the top of the high arc wall 3656 of the turning disc 365, one end 3661 of the torsion spring 366 is placed on the end wall 36510 of the low arc wall 3659, between the end wall 36510 of the low arc wall 3659 and the pin 3636 of the pin disc 363, and the other end 3662 of the torsion spring 366 is placed on the end wall 3657 of the high arc wall 3656, thus locking the turning disc 365 on the fixed sleeve 361. Then one end of the hollow shaft 3513 of the first secondary roller 351 near the sector bulge 35110 is inserted from the end near the high and low arc walls 3656 and 3659 of the turning disc 365 into the hollow shaft 3613 of the fixed sleeve 361, subsequently the turning cylinder 354 is sheathed from the end of the hollow shaft 3513 of the first secondary roller 351 near the sector bulge 3515, and the convex-shaped annular step 35420 of the turning cylinder 354 is jogged with the convex-shaped annular step 36511 on the end of the turning disc 365 as a whole, thus forming the roller system 3. The rotating shaft of the roller system 3 is the hollow shaft 3513 of the first secondary roller, one of its ends is mounted on the support 381 of the base 38, its other end is mounted on the support 386, and meanwhile the notch 3616 of the annular disc 3611 of the fixed sleeve 361 is jogged with the bulge 385 of the base 38, such that the fixed sleeve 361 is fixed on the base 38, and meanwhile the neutral position between two sector bulges 3548 and 35411 on the closed end surface of the turning cylinder 354 is directed to the bulge 382 of the base 38, making the turning cylinder 354 rotate within the preset turning angle ϕ range of louver blades.

Figure 16:
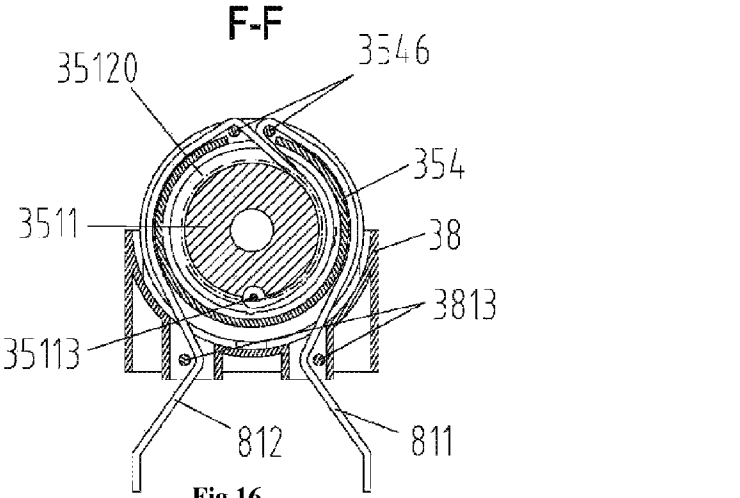
FIG. 16 is an F-F sectional view of the connection type between the roller system with one secondary louver blade and the secondary ladder tapes.
Figure 15:
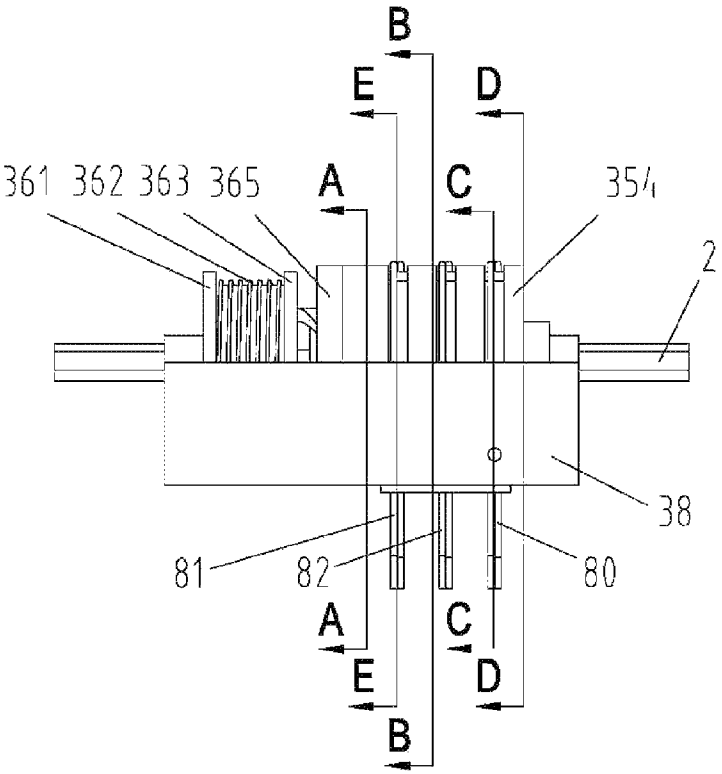
FIG. 15 is the front view and the schematic diagram of profile positions of the roller system with one secondary louver blade.

FIG. 16 is an F-F sectional view of FIG. 15, and this diagram shows the connection type between the front and rear cords 811 and 812 of the first secondary ladder tape 81 and the roller mechanism 35, wherein upper ends of the front and rear cords 811 and 812 are around the turning cylinder 354 and embedded into the annular groove 3512, then pass through the hole 3545 of the turning cylinder 354, are wound on the annular groove 3512 of the first secondary roller 351 and are fixed on the first secondary roller 351 by the pin shaft 35113.

Figure 17:
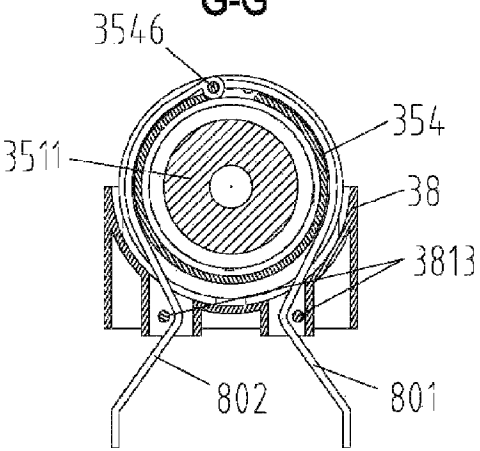
FIG. 17 is a G-G sectional view of the connection type between the roller system with one secondary louver blade and the primary ladder tape.

FIG. 17 is an G-G sectional view of FIG. 15, and this diagram shows the connection type between the front and rear cords 801 and 802 of the primary ladder tape 80, wherein upper ends of the front and rear cords 801 and 802 are around and embedded into the annular groove 3544 of the turning cylinder 354 and on the top of the annular groove 3544, are fixed on the turning cylinder 354 by the pin shaft 3546.

Figure 18A:
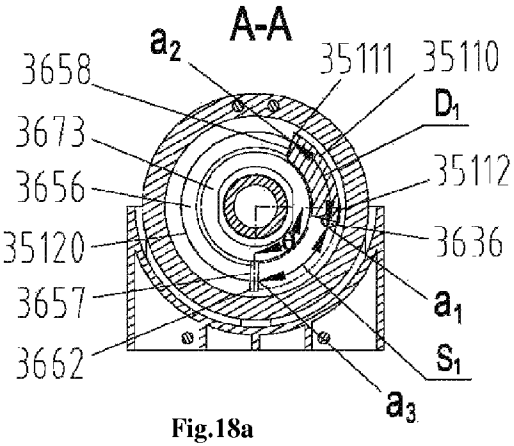
FIG. 18*a* is an A-A sectional view of the roller system with one secondary louver blade.
Figure 18B:
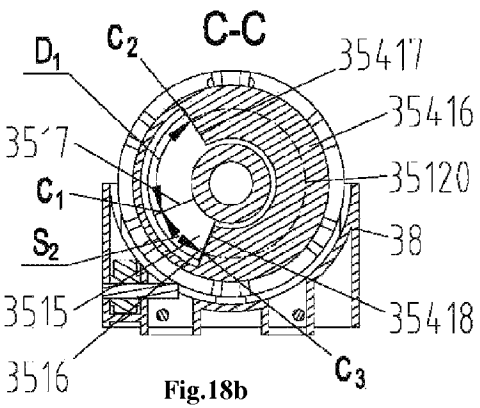
FIG. 18*b* is a C-C sectional view of the roller system with one secondary louver blade.
Figure 18C:
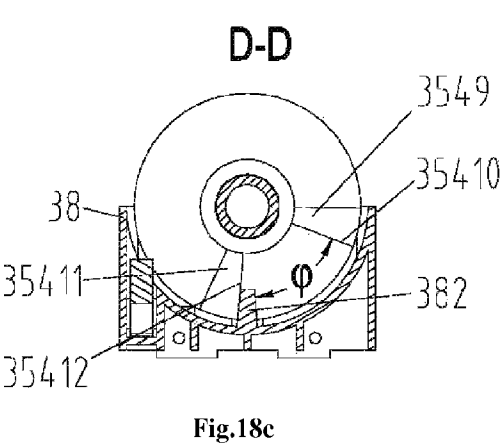
FIG. 18*c* is a D-D sectional view of the roller system with one secondary louver blade.
Figure 19A:
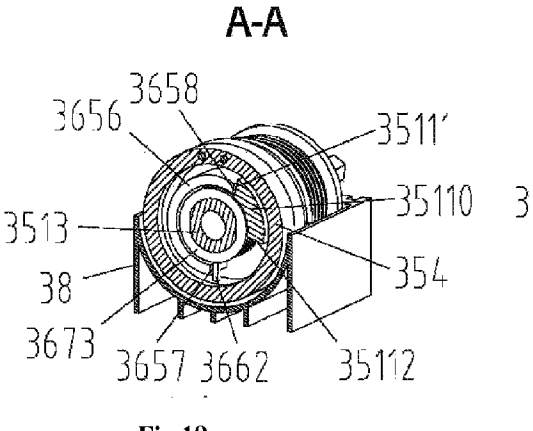
FIG. 19*a* shows the interactive relationship between the first secondary roller and the cam pin of the roller system with one secondary louver blade (at the initial position).
Figure 19B:
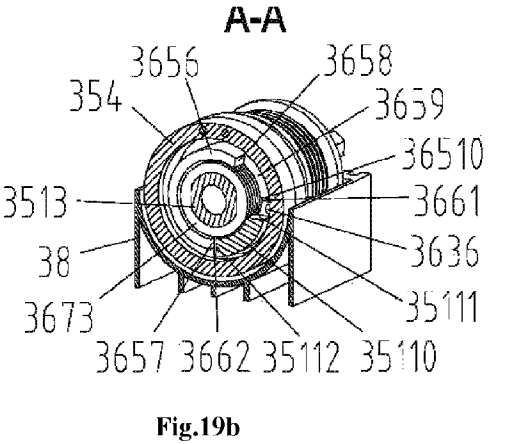
FIG. 19*b* shows the interactive relationship between the first secondary roller and the cam pin of the roller system with one secondary louver blade (when the first secondary louver blade rises to the position $D_1$).
Figure 19C:
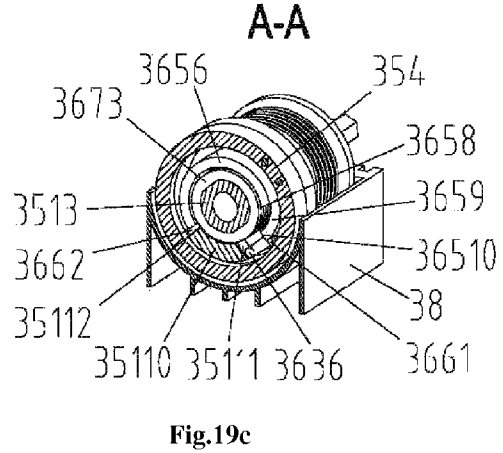
FIG. 19*c* shows the interactive relationship between the first secondary roller and the cam pin of the roller system with one secondary louver blade (when the first secondary louver blade and the primary louver blade turn an angle ϕ to the closed position).

FIG. 18*a* is an A-A sectional view of the initial position (corresponding to the position of louver blades as shown in FIG. 54*a*) where the first secondary roller 351 of the roller system of the pitch-variable combinatorial louver of the invention with one secondary louver blade interacts with the turning disc 365, FIG. 18*b* is a C-C sectional view of the initial position (corresponding to the position of louver blades as shown in FIG. 54*a*) where the first secondary roller 351 of the roller system of the pitch-variable combinatorial louver of the invention interacts with the turning cylinder 354, and FIG. 18*c* is a D-D sectional view of the initial position (corresponding to the position of louver blades as shown in FIG. 54*a*) where the turning cylinder 354 of the roller system of the pitch-variable combinatorial louver of the invention interacts with the base 38; FIG. 19*a*, FIG. 19*b* and FIG. 19*c* are A-A three-dimensional sectional views of three turning positions wherein the first secondary roller of the roller system interacts with the torsion spring and the pin. When the blade group 9 is at the initial position as shown in FIG. 54*a*, the end wall 35111 of the sector bulge 35110 of the first secondary roller 351 of the roller mechanism 35 is close to the junction between the high and low arc walls 3656 and 3659 of the turning disc 365 of the cam pin turning mechanism 36, the convex platform 3644 of the sliding cam 364 of the cam pin turning mechanism 36 touches the convex platform 3654 of the cam on the end wall of the turning disc, and the head of the pin 3636 of the pin disc 363 is higher than the top of the low arc wall 3659, but this does not obstruct the sector bulge 35110 of the first secondary roller 351 from passing by during rotating (as shown in FIG. 18*a* and FIG. 19*a*); and the end wall 3516 of the sector bulge 3515 of the first secondary roller 35 is close to the end wall 35418 of the annular bulge 35416 on the inner wall of the closed end surface of the turning cylinder 354 (as shown in FIG. 18*b*), and the end wall 35412 of the sector bulge 35411 on the outer wall of the closed end surface of the turning cylinder 354 is closely leaned on the end wall of the bulge 382 of the base (as shown in FIG. 18*c*).

When the sector bulge 35110 of the first secondary roller 351 is rotated to the position where its end wall 35112 starts to touch one end 3662 of the torsion spring 366 (as shown in FIG. 18*a* and FIG. 19*b*), the front and rear cords 811 and 812 of the first secondary ladder tape 81 of the first secondary louver blade 91 are wound by the first secondary roller 351, such that the first secondary louver blade 91 leaves from the position where it is superposed with the primary louver blade 90 and horizontally rises an altitude $D_1$ relative to the primary louver blade 90, at this point the end wall 3516 of the sector bulge 3515 of the first secondary roller 351 just touches the end wall 35417 of the annular bulge 35416 on the inner wall of the closed end surface of the turning cylinder 354, the cam pin turning mechanism 36 and the turning cylinder 354 are kept still, and the end wall 35415 of the sector bulge 35414 on the outer wall of its closed end surface is still closely leaned on the end wall of the bulge 382 of the base 38 (as shown in FIG. 18*c*).

After the end wall 35112 of the sector bulge 35110 of the first secondary roller 351 touches one end 3662 of the torsion spring 366, the first secondary roller 351 continues to rotate, and the end wall 3516 of the sector bulge 3515 of the first secondary roller 351 is pressed against the end wall 35417 of the annular bulge 35416 on the inner wall of the closed end surface of the turning cylinder 354 and pushes the turning cylinder 354 to rotate ϕ until the end wall 35410 of the annular bulge 3549 on the outer wall of its closed end surface is closely leaned on the bulge 382 of the base 38; during the rotating process of the turning cylinder 354, due to the action of the compression spring 362, the end wall cam of the turning disc 365 is changed from the position where the convex platform 3654 touches the convex platform 3644 of the sliding cam 364 to the state in which two transition bevels 3653 and 3643 are touched and gradually changed from partial matching to complete matching, such that the end wall plane 36514 of the turning disc 365 touches the bottom 3646 of the sliding cam 364; the sliding cam 364 can axially slide only because the raised key 3645 is jogged with the notch 3615 of the annular step 3612 of the hollow shaft 3613 of the fixed sleeve 361, as the pin 3636 of the pin disc 363 is inserted in the pin hole 3655 of the turning disc 365, it is driven to rotate by the turning cylinder 354, and meanwhile under the spring pressure of the compression spring 362, the pin disc 363 presses the sliding cam 364 to axially slide together towards the turning disc 365, such that the pin 3636 of the pin disc 363 gradually extends along the end wall 35111 of the sector bulge 35110 of the first secondary roller 351 (as shown in FIG. 19*c*).

When the first secondary louver blade 91 completes relative rising and turn to the closed position together with the primary louver blade 90 along with the turning cylinder 354, the actuator rotating reversely drives the hollow rotating shaft of the first secondary roller 351 to rotate reversely, then the primary and secondary louver blades 9 are withdrawn in the original order, namely, first the primary and secondary louver blades 9 simultaneously turn to a horizontal position as shown in FIG. 54*b*, while the primary and secondary louver blades 9 turn to the horizontal position, the end wall 35111 of the sector bulge 35110 of the first secondary roller 351 is pressed against the pin 3636 of the pin disc 363, then the pin 3636 pushes the other end 3661 of the torsion spring 366 to rotate a small angle towards the circumferential direction of the end wall 36510 of the low arc wall 3659 of the turning disc 365, so as to eliminate the effect that the torsion spring 366 locks the turning disc 365 on the fixed sleeve 361, and then the first secondary roller 351 presses the pin 3636 of the pin disc 363 through the end wall 35111 of its sector bulge 35110, the pin 3636 presses one end 3661 of the torsion spring 366, and the end 3661 of the torsion spring 366 presses the end wall 36510 of the low arc wall 3659 of the turning disc 365, and in such a transmission relation the turning disc 365 together with the turning cylinder 354 is pushed to turn an angle ϕ until the end wall 35412 of the sector bulge 35411 on the outer wall of the closed end surface of the turning cylinder 354 is blocked by the bulge 382 of the base 38 and it does not rotate any more, thus driving the primary and secondary louver blades 9 through the ladder tape 8 to return from the closed position as shown in FIG. 54 to the horizontal position as shown in FIG. 54*b*. During this rotating process, complete matching of the transition bevel 3643 of the sliding cam 364 of the cam pin turning mechanism 36 with the transition bevel 3653 of the end wall cam of the turning disc 365 is changed into touching of the convex platform 3644 of the sliding cam 3643 with the convex platform 3654 of the end wall cam of the turning disc 365, such that sliding cam 364 pushes the pin disc 363 to slide away from the turning disc 365, resulting in that the pin 3636 of the pin disc 363 is withdrawn to the initial position as shown in FIG. 19*b*, and while the first secondary roller 351 continues to rotate reversely, its sector bulge 35110 can pass by; when the first secondary louver blade 91 falls to the position where it is superposed with the primary louver blade 90 as shown in FIG. 54*a*, the sector bulge 35110 of the first secondary roller 351 returns to the initial position, at this point, the end wall 3516 of the sector bulge 3515 of the first secondary roller 351 is propped by the end wall 35418 of the annular bulge 35416 on the inner wall of the closed end surface of the turning cylinder 354, and the end wall 35412 of the sector bulge 35411 on the outer wall of the closed end surface of the turning cylinder 354 is propped by the bulge 382 of the base, such that the first secondary roller 351 can not continue to rotate reversely; and the first secondary roller 351 rotates reversely to the position as shown in FIG. 19*a* from the position as shown in FIG. 19*c*, namely the first secondary louver blade 91 returns from the position as shown in FIG. 54*c* to the position as shown in FIG. 54*a*.

The internal relationship of the roller mechanism 35 is dependent on relative lifting height $D_1$ and turning closed angle ϕ of the primary and secondary louver blades 9. FIG. 18*a* is the A-A sectional view of the roller system 3 of the pitch-variable combinatorial louver with one secondary louver blade, in which the dotted line represents the position where the sector bulge 35110 of the first secondary roller 351 rises $D_1$ relatively. As described above, the fixed sleeve 361 passes through the annular cavity between the hollow shaft 3513 of the first secondary roller 351 and the inner ring 36514 of the turning disc 365 and extends into the turning disc 365, the torsion spring 366 is sheathed on the torsion spring jacket 367, and then nested on the fixed sleeve 361 through the torsion spring jacket 367 to make it not slide away, both ends 3661 and 3662 of the torsion spring 366 are respectively laid on the low arc wall 3659 and the high arc wall 3656 of the turning disc 365, the height of the low arc wall 3659 of the turning disc 365 is higher than the diameter of the steel wire of the torsion spring 366, and the other end 3662 of the torsion spring 366 is flush with the height of the high arc wall 3659 and the end of the torsion spring jacket 367 jogged with the fixed sleeve 361. The pin 3636 of the pin disc 363 is inserted into the pin hole 3655 of the turning disc 365 until the head of the pin 3636 is flush with the top of the low arc wall 3659 and together with the end wall 36510 of the low arc wall 3659, holds the end 3661 of the torsion spring 366. The end wall 35112 of the sector bulge 35110 of the first secondary roller 351 is close to one end 3662 of the torsion spring 366, and the other end wall 35111 of the sector bulge 35110 of the first secondary roller 351 is close to the pin 3636 of the pin disc 363, therefore their design principles are as follows: one end 3661 of the torsion spring 366 is placed at the horizontal position on the circumference, and the pin 3636 of the pin disc 363 is placed below; in the drawing, the circle with dash dot line is the pitch circle 35120 where the cords of the secondary ladder tape is embedded into the annular groove 3512 of the first secondary roller 351, a parallel line which is parallel to one end 3661 of the torsion spring 366 and has a distance equal to the diameter of the pin 3636 is drawn, this parallel line intersects with the pitch circle 35120 in the drawing to form an intersection point $a_1$, a point $a_2$ is found from this point along the pitch circle 35120 of the annular groove 3512 anti-clockwise, and the arc length of the pitch diameter of the annular groove 3512 between the two points is equal to the maximum height $D_1$ that the first secondary louver blade 91 rises relative to the primary louver blade 90, thus the junction 3658 between the low arc wall 3659 and the high arc wall 3656 of the turning disc 365 can be determined; a point $a_3$ of intersection with the end wall of one end 3662 of the torsion spring 366 is found from the intersection point $a_1$ along the pitch circle 35120 of the annular groove 3512 clockwise, then the point $a_3$ is the point of intersection between the other end wall 35112 of the sector bulge 35110 of the first secondary roller 351 and the pitch circle 35120 of the annular groove 3512, and the arc length of the pitch diameter of the annular groove 3512 between the point $a_1$ and the point $a_3$ is referred to as $S_1$; $S_1$ could be determined in the consideration of respective strength of the sector bulge 35110 of the first secondary roller 351 and the high arc wall 3656 of the turning disc 365, thus the opening angle θ between two ends 3661 and 3662 of the torsion spring 366 is also determined, and for convenience of subsequent description of the situations with two secondary louver blades and three secondary louver blades, here the opening angle θ between two ends of the torsion spring 366 is assumed to be 90° to determine $S_1$.

FIG. 18*b* is a C-C sectional view of FIG. 17. The sector bulge 3515 of the first secondary roller 351 is jogged with the annular bulge 35416 on the inner wall of the closed end surface of the turning cylinder 354, at the initial position, one end wall 3516 of the sector bulge 365 of the first secondary roller 351 is close to one end wall 35418 of the annular bulge 35416 on the inner wall of the closed end surface of the turning cylinder 354. First, a point $c_1$ is randomly selected on the pitch circle 35120 of the annular groove 3512, then the end wall 3516 of the sector bulge 3515 of the first secondary roller 351 can be determined by drawing a radial line from this point, a point $c_2$ is found from the point $c_1$ along the pitch circle 35120 of the annular groove 3512 in the clockwise direction, to make the arc length of the pitch diameter of the annular groove 3512 between $c_1$ and $c_2$ equal to $D_1$ between the first secondary louver blade 91 and the primary louver blade 90 (see FIG. 54*b*), thus a neutral position between the sector bulge 3515 of the first secondary roller 351 and the annular bulge 35416 on the inner wall of the closed end surface of the turning cylinder 354 is determined. A point $c_3$ is found from the point $c_1$ along the pitch circle 35120 of the annular groove 3512 in the anti-clockwise direction, the arc length of the pitch diameter of the annular groove 3512 between $c_1$ and $c_3$ is $S_2$, $S_2$ could be determined in the consideration of respective strength of the sector bulge 3515 of the first secondary roller 351 and the annular bulge 35416 on the inner wall of the closed end surface of the turning cylinder 354, and if $S_2$ is determined, the circumferential sizes of the sector bulge 3515 of the first secondary roller 351 and the annular bulge 35416 on the inner wall of the closed end surface of the turning cylinder 354 are determined.

FIG. 18*c* is a D-D sectional view of FIG. 17. At the initial position, one side 35412 of the sector bulge 35411 on the outer wall of the closed end surface of the turning cylinder 354 is close to one side of the convex platform 382 of the base 38, and the angle between one side 35410 of the sector bulge 3549 on the outer wall of the closed end surface of the turning cylinder 354 and the other side of the bulge 382 of the base 38 is equal to the turning closed angle ϕ of the primary and secondary louver blades 9.

Example 2

Turning Cylinder with Two Rollers Mounted Therein, a Structure with Two Secondary Louver Blades A movement cycle of relative lifting and turning of louver blades of the pitch-variable combinatorial louver with two secondary louver blades is as follows: (1) the primary louver blade 90 is spread over the louver at an equal pitch, and the secondary louver blades 91 and 92 are superposed on the primary louver blade 90 (corresponding to FIG. 46*a*); (2) the first secondary louver blade 91 rises to the position $D_1$–$D_2$ relative to the primary louver blade 90, and the second secondary louver blade 92 is still superposed on the primary louver blade 90 (corresponding to FIG. 46*b*); (3) the first secondary louver blade 91 continues to rise to the position $D_1$ relative to the primary louver blade 90, and meanwhile the second secondary louver blade 92 rises to the position $D_2$ relative to the primary louver blade 90 (corresponding to FIG. 46*c*); (4) the primary and secondary louver blades 90, 91 and 92 simultaneously rotate ϕ from a horizontal position to close the louver (corresponding to FIG. 46*d*); (5) the primary and secondary louver blades 90, and 92 simultaneously turn back ϕ to the horizontal position (corresponding to FIG. 46*c*); (6) the first secondary louver blade 91 and the second secondary louver blade 92 fall $D_2$ relative to the primary louver blade 90, at this point the second secondary louver blade 92 is superposed on the primary louver blade 90 (corresponding to FIG. 46*b*); and (7) the first secondary louver blade 91 falls $D_1$–$D_2$ relative to the primary louver blade 90, until it is superposed on the second secondary louver blade 92 (corresponding to FIG. 46*a*), here D/L is set to be 1.2, and $D_1$–$D_2$=$D_2$=D/3.

Figure 20:
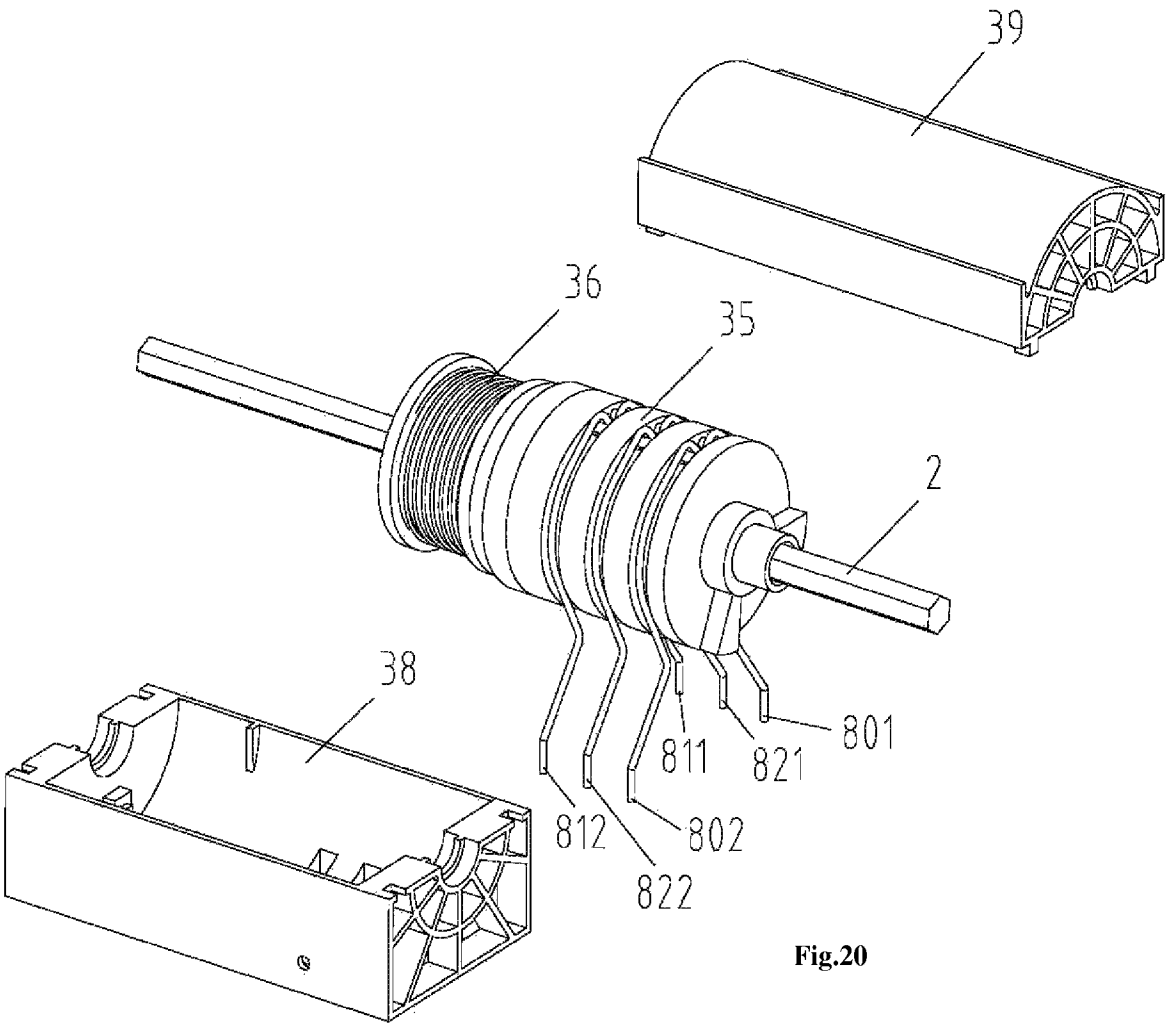
FIG. 20 is a three-dimensional explosive diagram of a roller system with two secondary louver blades.
Figure 21:
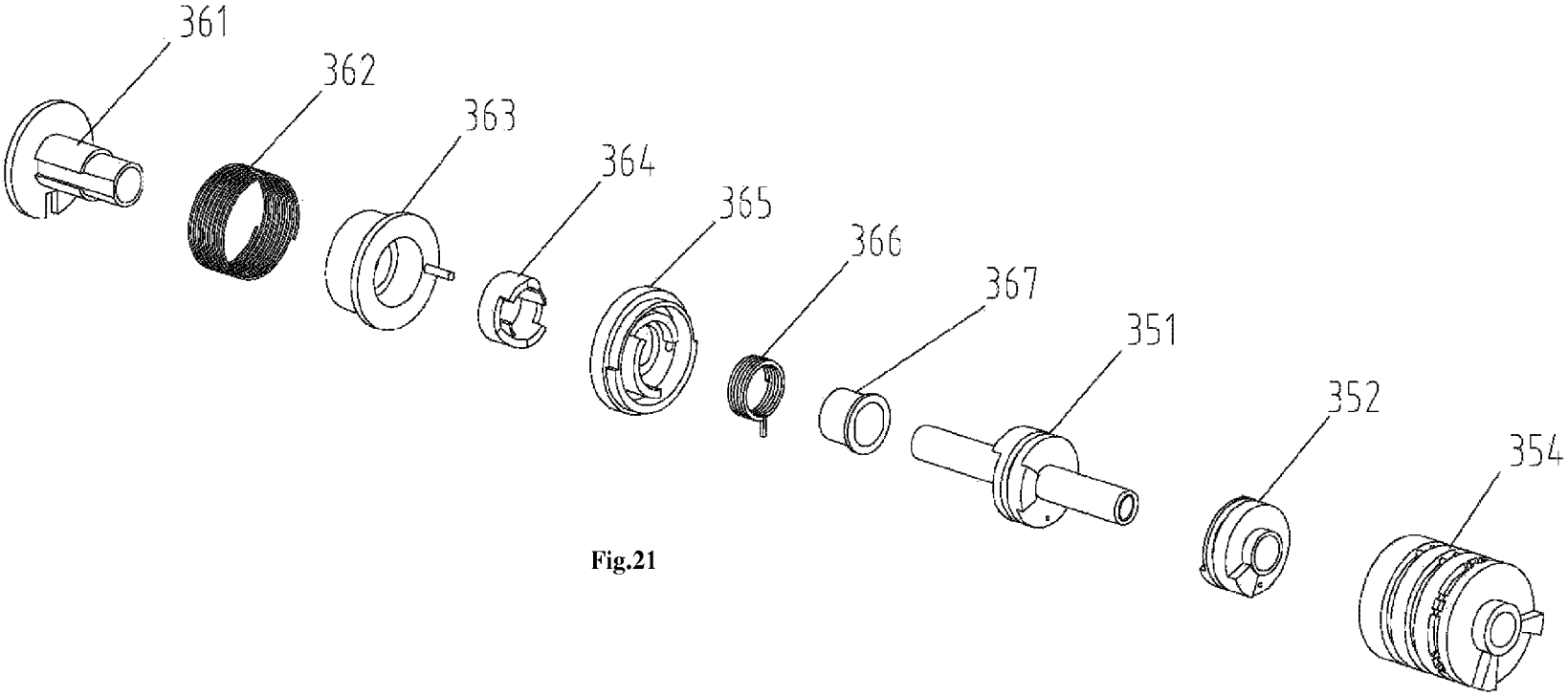
FIG. 21 is a three-dimensional explosive diagram of the roller system (without the base and the top cover) with two secondary louver blades.
Figure 23A:
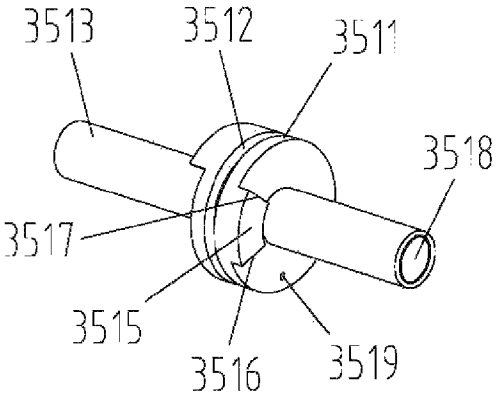
FIG. 23 is a three-dimensional diagram of the first secondary roller of the roller mechanism of the roller system with two secondary louver blades.
Figure 23B:
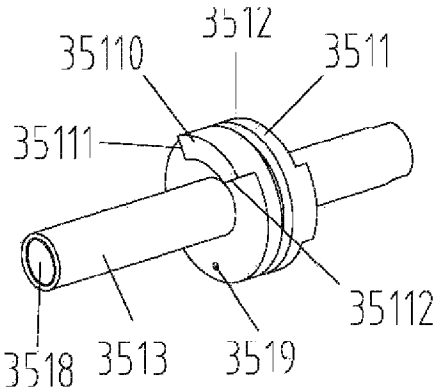
Figure 22A:
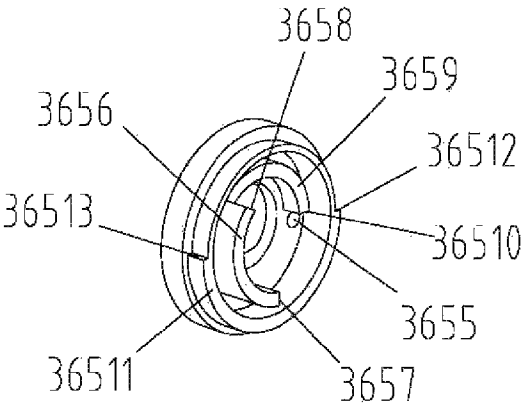
FIG. 22 is a three-dimensional diagram of the turning disc of the cam pin turning mechanism of the roller system with two secondary louver blades.
Figure 22B:
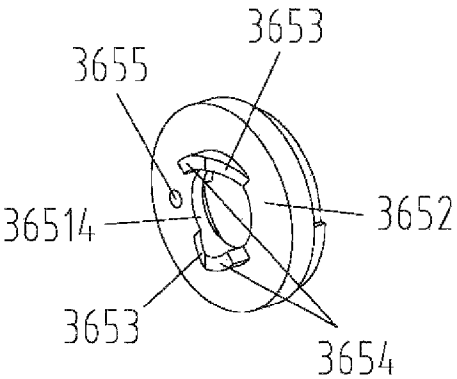
Figure 25A:
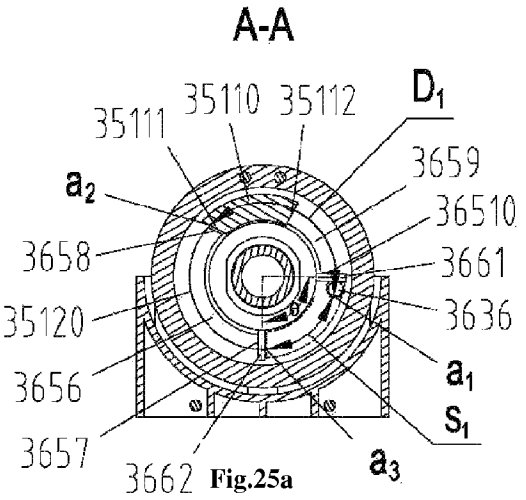
FIG. 25*a* is an A-A sectional view of the roller system with two secondary louver blades.
Figure 25B:
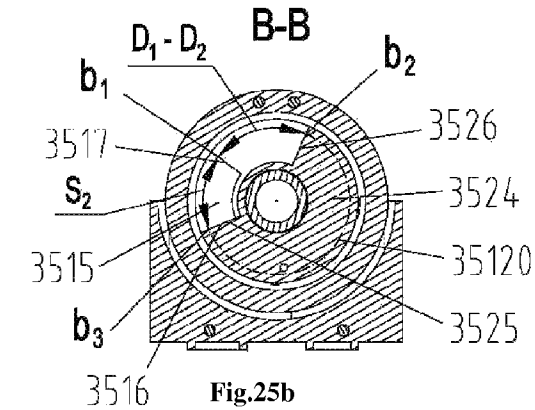
FIG. 25*b* is a B-B sectional view of the roller system with two secondary louver blades.
Figure 25C:
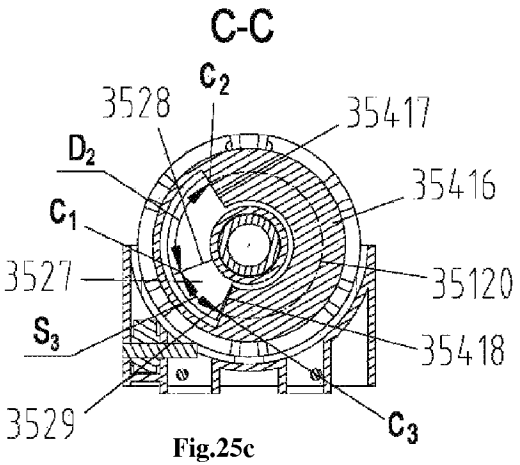
FIG. 25*c* is a C-C sectional view of the roller system with two secondary louver blades.
Figure 25D:
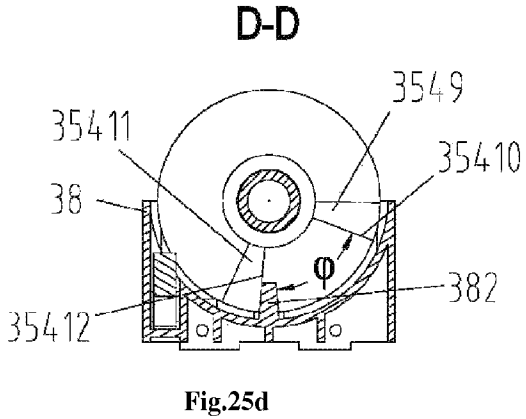
FIG. 25*d* is a D-D sectional view of the roller system with two secondary louver blades.

According to FIGS. 20 and 21, the roller system 3 for the pitch-variable combinatorial louver with two secondary louver blades comprises a roller mechanism 35 and a cam pin turning mechanism 36, the roller mechanism 35 differs from the roller mechanism in Example 1 in that a second secondary roller 352 is added, and meanwhile an annular groove 3542 is added in the outer ring of the turning cylinder 354, for embedding the second secondary ladder tape 82 restricting the second secondary louver blade 92, namely, the roller mechanism 35 comprises a turning cylinder 354, a first secondary roller 351 and a second secondary roller 352, the first secondary roller 351 and the second secondary roller 352 are mounted in the turning cylinder 354; and the cam pin turning mechanism 36 is almost the same as the cam pin turning mechanism 36 in Example 1, but the only difference is that the first secondary roller 351 in this Example is required to rotate a larger angle, and because the distance $D_1$ that the first secondary louver blade 91 rises relative to the primary louver blade 90 is longer than a single secondary louver blade, positions of the sector bulges 35110 and 3515 on both sides of the first secondary roller 351 should be adjusted in corresponding rotation, the junction 3658 between the high arc wall 3656 and low arc wall 3659 of the turning disc 365 which are step-like should also be shifted an angle anti-clockwise correspondingly, and an annular groove 3542 is added in the outer ring of the turning cylinder 354 (as shown in FIGS. 22, 23 and 7).

Figure 24A:
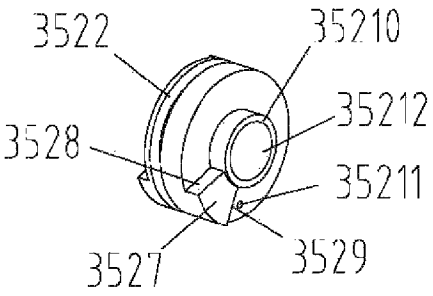
FIG. 24 is a three-dimensional diagram of the second secondary roller of the roller mechanism of the roller system with two secondary louver blades.
Figure 24B:
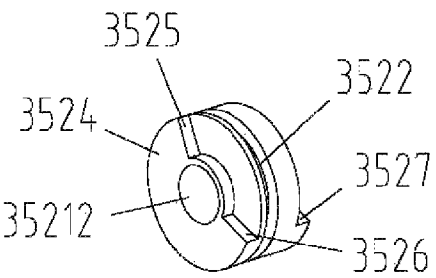

FIG. 24 is a three-dimensional diagram of the second secondary roller 352 of the roller mechanism 35. An inner ring 35210 is set on the annular disc of the second secondary roller 352, an annular groove 3522 is set in the outer ring of the second secondary roller 352, a sector bulge 3527 and a sector bulge 3524 with an annular convex platform 35210 are each axially held out from both sides of the second secondary roller 352 and a pin hole 35211 is set there for fixing upper ends of the front and rear cords 821 and 822 of the second secondary ladder tape.

Figures 26, 27:
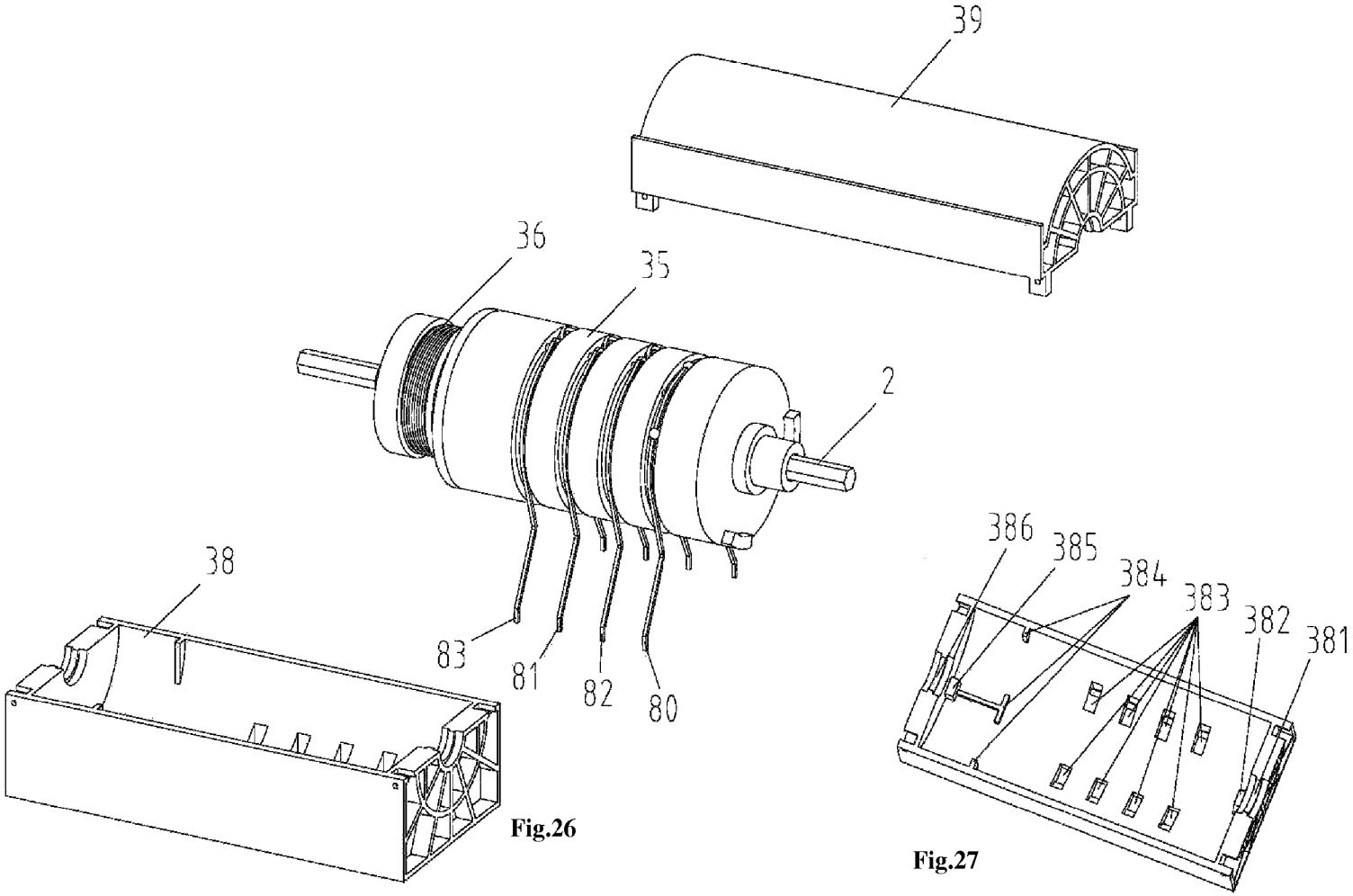
FIG. 26 is a three-dimensional explosive diagram of a roller system with three secondary louver blades (dual binary pitch).
FIG. 27 is a three-dimensional diagram of the base of the roller system with three secondary louver blades (dual binary pitch).
Figure 46A:
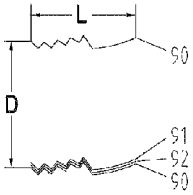
FIG. 46 is a cross-section schematic diagram of a combinatorial louver blade unit of a pitch-variable combinatorial louver with two secondary louver blades in which the secondary louver blades rise and fall relatively, and the primary and secondary louver blades turn over together.
Figure 46B:
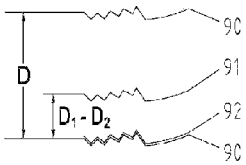
Figure 46C:
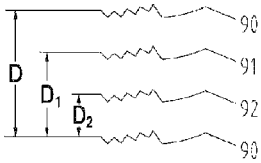
Figure 46D:
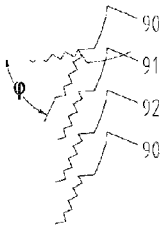

The internal relationship of the roller mechanism 35 of the pitch-variable combinatorial louver with two secondary louver blades is dependent on relative lifting heights $D_1$ and $D_2$ and turning closed angle ϕ of the primary and secondary louver blades 9, and the design principles among them can be based on the structure of the roller mechanism 35 in Example 1. FIG. 27*a* is the A-A sectional view of FIG. 26, and shows the initial position where the first secondary roller 351 of the roller mechanism 35 interacts with the turning disc 365 (corresponding to FIG. 46*a*), and in the diagram the dotted line represents the position of the sector bulge 35110 of the first secondary roller 351 when the first secondary louver blade 91 rises $D_1$ relative to the primary louver blade 90 (corresponding to FIG. 46*a*); compared to FIG. 18*a* of Example 1, the sector bulge 35110 of the first secondary roller 351 is located after rotating an angle in the anti-clockwise direction as shown in FIG. 27*a*, such that the arc length between the intersection points $a_1$ and $a_2$ of the sector bulge 35110 of the first secondary roller 351 on the pitch circle 35120 of the annular groove 3512 is equal to the maximum height $D_1$ that the first secondary louver blade 91 rises relative to the primary louver blade 90, and meanwhile the junction 3658 between the low arc wall 3659 and the high arc wall 3656 of the turning disc 365 is also located after anti-clockwise rotating the same angle along with it. FIG. 27*b* is the B-B sectional view of FIG. 26, and shows the initial position where the first secondary roller 351 of the roller mechanism 35 interacts with the second secondary roller 352 (corresponding to FIG. 46*a*), the sector bulge 3515 of the first secondary roller 351 is jogged with the annular bulge 3524 of the second secondary roller 352, and at the initial position one end wall 3516 of the sector bulge 3515 of the first secondary roller 351 is close to one end wall 3525 of the annular bulge 3524 of the second secondary roller 352; first, a point $b_1$ is randomly selected on the pitch circle 35120 of the annular groove 3512, then the end wall 3516 of the sector bulge 3515 of the first secondary roller 351 can be determined by drawing a radial line from this point, a point $b_2$ is found from the point $b_1$ along the pitch circle 35120 of the annular groove 3512 in the clockwise direction, to make the arc length of the pitch diameter of the annular groove 3512 between $b_1$ and $b_2$ equal to $D_1$–$D_2$ between the first secondary louver blade 91 and the second secondary louver blade 92 (as shown in FIG. 46*b*), thus a neutral position between the sector bulge 3515 of the first secondary roller 351 and the annular bulge 3524 of the second secondary roller 352 is determined, and a point $b_3$ is found from the point $b_1$ along the pitch circle 35120 of the annular groove 3512 in the anti-clockwise direction, the arc length of the pitch diameter of the annular groove 3512 between $b_1$ and $b_3$ is $S_2$, $S_2$ could be determined in the consideration of respective strength of the sector bulge 3515 of the first secondary roller 351 and the annular bulge 3524 of the second secondary roller 352, and if $S_2$ is determined, the circumferential sizes of the sector bulge 3515 of the first secondary roller 351 and the annular bulge 3524 of the second secondary roller 352 are determined. FIG. 27*c* is the C-C sectional view of FIG. 26, and shows the initial position where the second secondary roller 352 of the roller mechanism 35 interacts with the turning cylinder 354 (corresponding to FIG. 46*a*), the sector bulge 3527 of the second secondary roller 352 is jogged with the annular bulge 35416 on the inner wall of the closed end surface of the turning cylinder 354, and at the initial position the end wall 3529 of the sector bulge 3527 of the second secondary roller 352 is close to the end wall 35418 of the annular bulge 35416 on the inner wall of the closed end surface of the turning cylinder 354; first, a point $c_1$ is randomly selected on the pitch circle 35120 of the annular groove 3512, then the end wall 3528 of the sector bulge 3527 of the second secondary roller 352 can be determined by drawing a radial line from this point, a point $c_2$ is found from the point $c_1$ along the pitch circle 35120 of the annular groove 3512 in the clockwise direction, to make the arc length of the pitch diameter of the annular groove 3512 between $c_1$ and $c_2$ equal to $D_2$ between the second secondary louver blade 92 and the primary louver blade 90 (as shown in FIG. 46*c*), thus a neutral position between the sector bulge 3527 of the second secondary roller 352 and the annular bulge 35416 on the inner wall of the closed end surface of the turning cylinder 354 is determined, and a point $c_3$ is found from the point $c_1$ along the pitch circle 35120 of the annular groove 3512 in the anti-clockwise direction, the arc length of the pitch diameter of the annular groove 3512 between $c_1$ and $c_3$ is $S_3$, $S_3$ could be determined in the consideration of respective strength of the sector bulge 3527 of the second secondary roller 352 and the annular bulge 35416 on the inner wall of the closed end surface of the turning cylinder 354, and if $S_3$ is determined, the circumferential sizes of the sector bulge 3527 of the second secondary roller 352 and the annular bulge 35416 on the inner wall of the closed end surface of the turning cylinder 354 are determined. FIG. 27*d* is the D-D sectional view of FIG. 26, and shows the initial position where the turning cylinder 354 of the roller mechanism 35 interacts with the base 38 (corresponding to FIG. 46*a*), and the structure and relationship of the sector bulges 3549 and 35411 on the outer wall of the closed end surface of the turning cylinder 358 and the convex platform 382 of the base are kept the same as Example 1.

Example 3

Turning Cylinder with Three Rollers Mounted Therein, a Structure with Three Secondary Louver Blades (Dual Binary Pitch)

A movement cycle of relative lifting and turning of combinatorial louver blades of the pitch-variable combinatorial louver with three secondary louver blades (dual binary pitch) is as follows: (1) the primary louver blade 90 is spread over the louver at an equal pitch, and the secondary louver blades 91, 92 and 93 are sequentially superposed on the primary louver blade 90 (corresponding to FIG. 47*a*); (2) the first secondary louver blade 91 and the second secondary louver blade 92 rises to the position $D_2$ relative to the primary louver blade 90 (corresponding to FIG. 47*b*); (3) the second secondary louver blade 92 is detached from the first secondary louver blade 91 and is located at the position $D_2$, the first secondary louver blade 91 and the third secondary louver blade 93 rise a distance $D_3$ relative to the primary louver blade 90, at this point the first secondary louver blade 91 is located at the position $D_2+D_3$, and the third secondary louver blade 93 is located at the position $D_3$ (corresponding to FIG. 47*c*); (4) the primary and secondary louver blades 90, 91, 92 and 93 simultaneously rotate $\phi$ from a horizontal position until the louver is closed (corresponding to FIG. 47*c*); (5) the primary and secondary louver blades 90, 91, 92 and 93 simultaneously turn back $\phi$ to the initial horizontal position (corresponding to FIG. 47*c*); (6) the first secondary louver blade 91 and the third secondary louver blade 93 fall a distance $D_3$ relative to the primary louver blade 90, until the third secondary louver blade 93 is superposed on the primary louver blade 90 (corresponding to FIG. 47*b*); and (7) the first secondary louver blade 91 and the second secondary louver blade 92 fall a distance $D_2$ relative to the primary louver blade 90, until the second secondary louver blade 92 is superposed on the third secondary louver blade 93, and the first secondary louver blade 91 is superposed on the second secondary louver blade 92 (corresponding to FIG. 47*a*), here D/L is set to be 1.6, $D_2$=D/2, and $D_3$=D/4.

Figure 28:
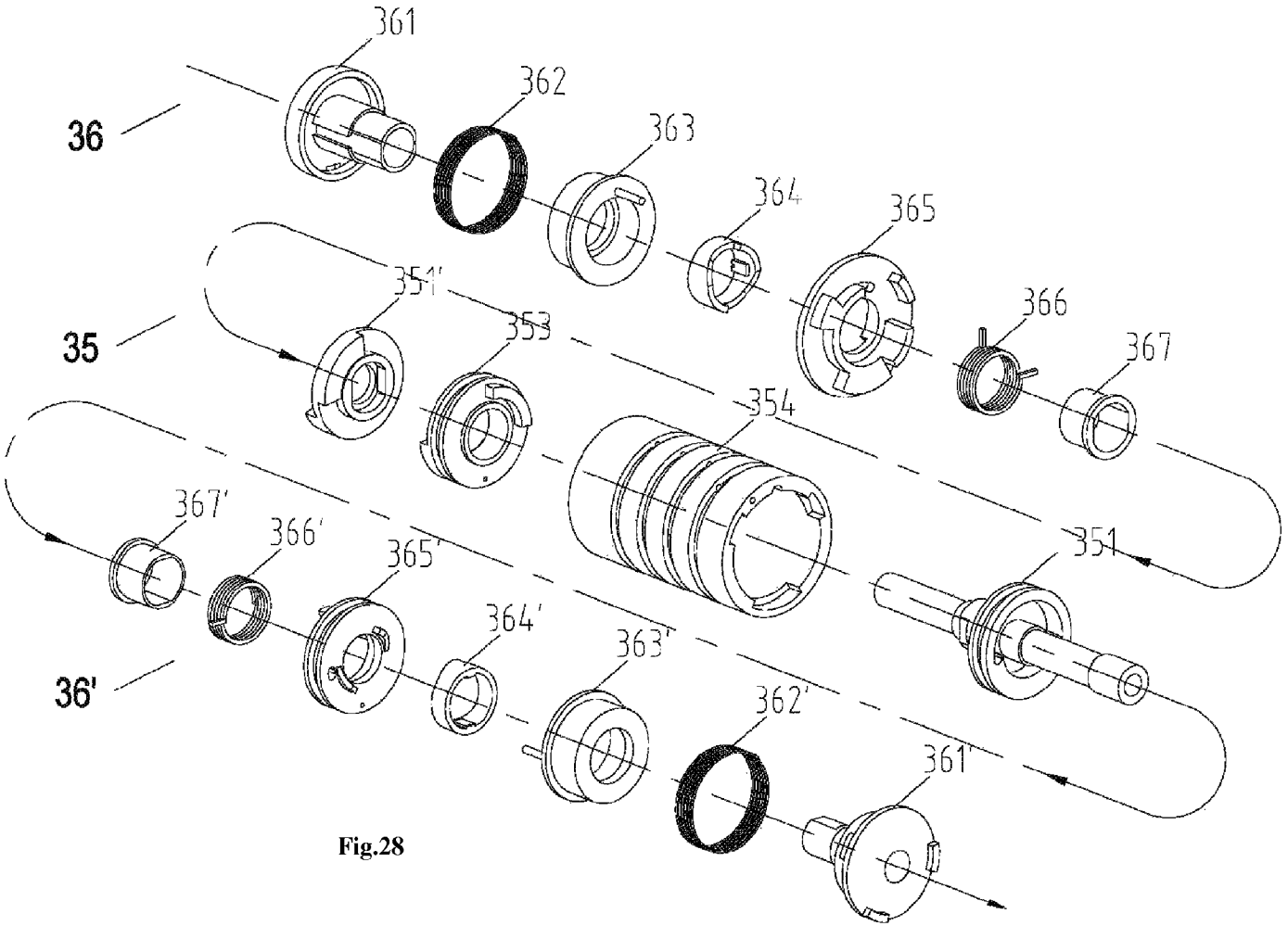
FIG. 28 is a three-dimensional explosive diagram of the roller system (without the base and the top cover) with three secondary louver blades (dual binary pitch).

According to FIGS. 26 and 28, the roller system for the pitch-variable combinatorial louver with three secondary louver blades (dual binary pitch) comprises a roller mechanism 35, a cam pin turning mechanism 36 and a cam pin turning mechanism 36', the roller mechanism 35 comprises a first secondary roller 351, a turning disc 365', a third secondary roller 353 and a turning cylinder 354, the first secondary roller 351, the turning disc 365' and the third secondary roller 353 are mounted within the turning cylinder 354, the cam pin turning mechanism 36 comprises a fixed sleeve 361, a compression spring 362, a pin disc 363, a sliding cam 364, a turning disc 365, a torsion spring 366 and a torsion spring jacket 367, and the cam pin turning mechanism 36' comprises a fixed sleeve 361', a compression spring 362', a pin disc 363', a sliding cam 364', a turning disc 365', a torsion spring 366' and a torsion spring jacket 367'.

Figure 32A:
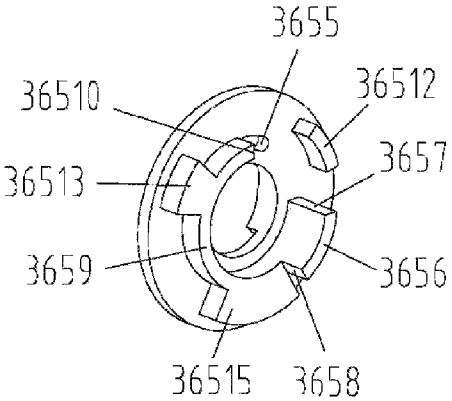
FIG. 32 is a three-dimensional diagram of the turning disc of the cam pin turning mechanism of the roller system with three secondary louver blades (dual binary pitch).
Figure 33A:
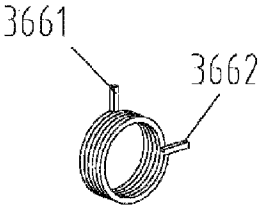
FIG. 33*a* is a three-dimensional diagram of the torsion spring I of the cam pin turning mechanism of the roller system with three secondary louver blades (dual binary pitch).
Figure 34A:
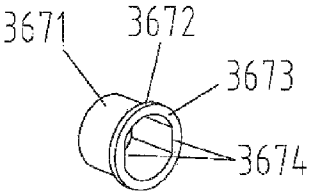
FIG. 34 is a three-dimensional diagram of the torsion spring sleeve of the cam pin turning mechanism of the roller system with three secondary louver blades (dual binary pitch).
Figure 32B:
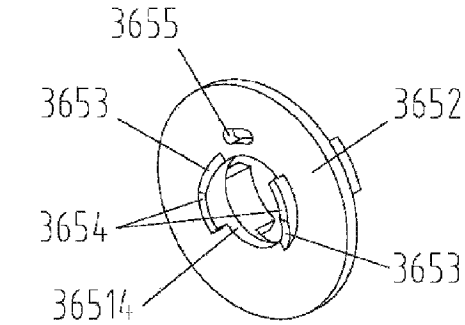
Figure 33B:
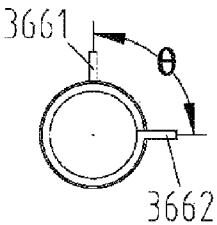
FIG. 33*b* is an axial view of the torsion spring I of the cam pin turning mechanism of the roller system with three secondary louver blades (dual binary pitch).
Figure 34B:
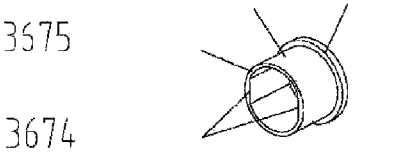

FIG. 29 is a three-dimensional diagram of the fixed sleeve 361 of the cam pin turning mechanism 36, FIG. 30 is a three-dimensional diagram of the pin disc 363 of the cam pin turning mechanism 36, FIG. 31 is a three-dimensional diagram of the sliding cam 364 of the cam pin turning mechanism 36, FIG. 32 is a three-dimensional diagram of the turning disc 365 of the roller mechanism 35, FIG. 33*a* is a three-dimensional diagram of the torsion spring 366 of the cam pin turning mechanism 36, FIG. 33*b* is an axial view of the torsion spring 366 of the cam pin turning mechanism 36, and FIG. 34 is a three-dimensional diagram of the torsion spring jacket 367 of the cam pin turning mechanism 36. The structure of the cam pin turning mechanism 36 of this Example is just the same as aforementioned examples, and only the junction 3658 between the high and low arc walls 3556 and 3559 of the turning disc 365 is rotated to the position closer to the end wall 3657 of the high arc wall 3656.

Figure 35A:
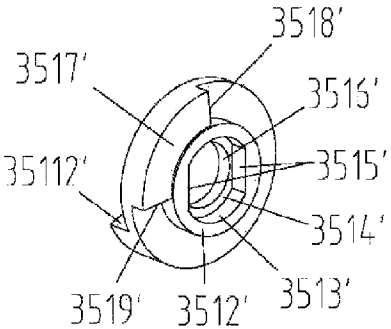
FIG. 35 is a three-dimensional diagram of a split wheel of the first secondary roller of the roller mechanism of the roller system with three secondary louver blades (dual binary pitch).
Figure 35B:
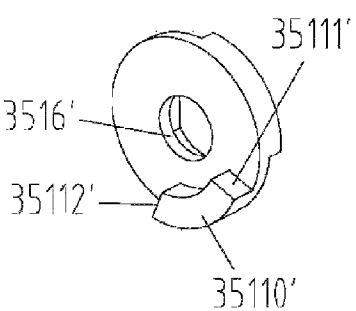

FIG. 35 is a three-dimensional diagram of the split wheel 351' of the first secondary roller 351 of the roller mechanism 35. The split wheel 351' is an annular disc with an inner ring 3516', a sector bulge 35110' having two end walls 35111' and 35112' and a sector bulge 3517' with an annular convex platform 3512' having two end walls 3518' and 3519' are each axially held out from both sides of the split wheel 351', the inner ring of the annular convex platform 3512' and the inner ring 3516' are step-like and have a mouth shape with upper and lower arc surfaces as well as left and right vertical planes 3515'.

Figure 36A:
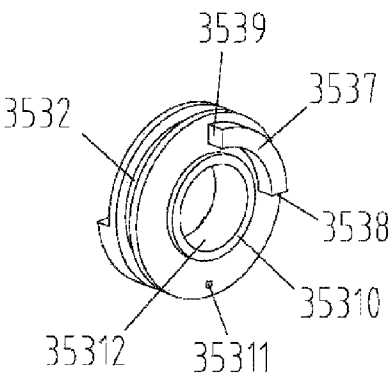
FIG. 36 is a three-dimensional diagram of the third secondary roller of the roller mechanism of the roller system with three secondary louver blades (dual binary pitch).
Figure 36B:
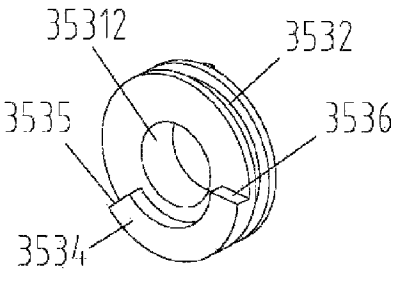

FIG. 36 is a three-dimensional diagram of the third secondary roller 353 of the roller mechanism 35. An inner ring 35310 is set on the annular disc of the third secondary roller 353, an annular groove 3532 is set in the outer ring, a sector bulge 3534 having two end walls 3515 and 3536 and a sector bulge 3537 having two end walls 3538 and 3539 are each axially held out from both sides of the third secondary roller 353 and a pin hole is set there for fixing upper ends of the front and rear cords 831 and 832 of the third secondary ladder tape.

Figure 37A:
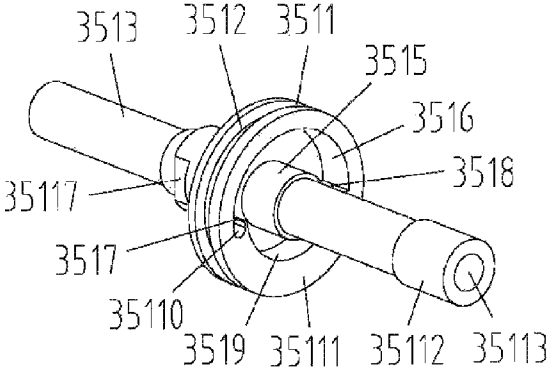
FIG. 37 is a three-dimensional diagram of the first secondary roller of the roller mechanism of the roller system with three secondary louver blades (dual binary pitch).
Figure 37B:
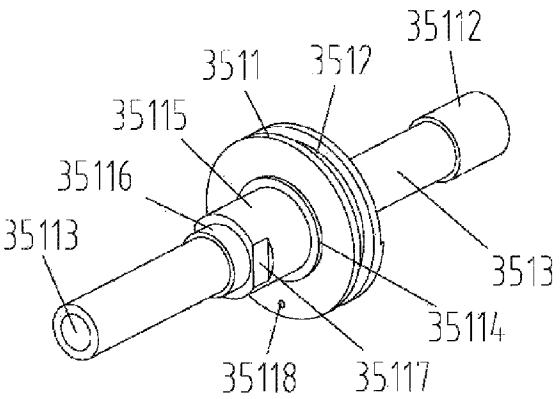

FIG. 37 is a three-dimensional diagram of the first secondary roller 351 of the roller mechanism 35. A hollow shaft 3513 which passes through its inner ring is set on the annular disc 3511 of the first secondary roller 351, an annular groove 3512 is set in the outer ring of the annular disc 3511, one side of the annular disc 3511 is a plane and there is a pin hole 35118 for fixing upper ends of the front and rear cords 811 and 812 of the first secondary ladder tape, the other side 35111 of the annular disc 3511 is axially cut to form two semi-annuluses 3516 and 3519 with different inner ring diameter, the two semi-annuluses 3516 and 3519 have boundary walls 3517 and 3518, a pin hole 35110 is drilled on the boundary wall 3517, and axial steps 35114, 35115 and 35116 are set on the hollow shaft 3513 at the junction with the left side of the annular disc 3511, wherein a segment of the axial step 35115 becomes an axial key because of being cut off two blocks 35117, and axial steps 3515 and 35112 with the same diameter are set at the junction with the right side of the annular disc 3511 and the right end.

Figure 38B:
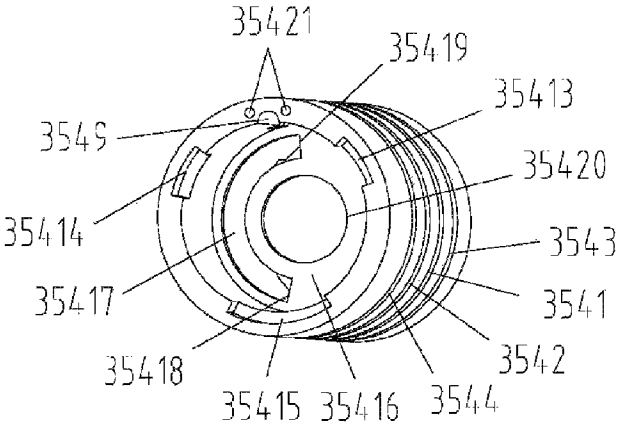
FIG. 38 is a three-dimensional diagram of the turning cylinder of the roller mechanism of the roller system with three secondary louver blades (dual binary pitch).
Figure 38A:
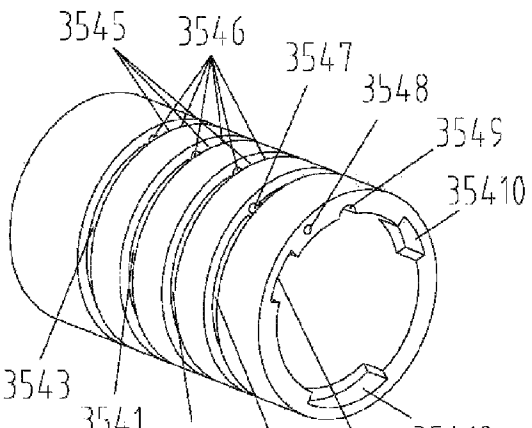
Figure 38C:
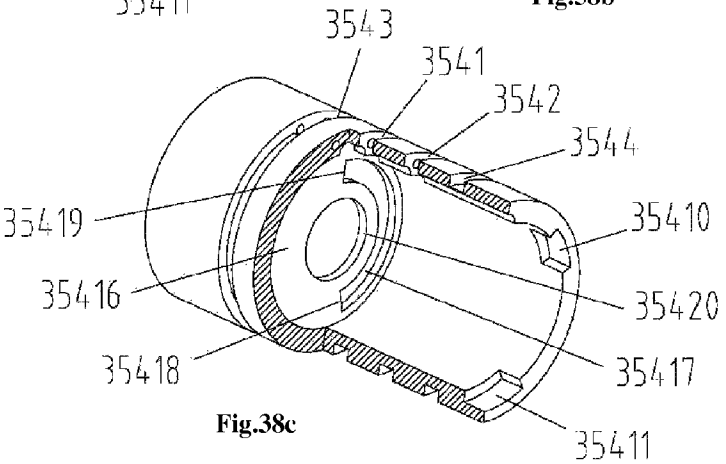

FIG. 38 is a three-dimensional diagram of the turning cylinder 354 of the roller mechanism 35. The turning cylinder 354 is a circular cylinder, on its outer ring surface, there are annular grooves 3541, 3542 and 3543 for embedding the secondary ladder tapes 81, 82 and 83 and an annular groove 3544 for embedding the primary ladder tape 80, a hole 3545 is set on the top of each of the annular grooves 3541, 3542 and 3543 and pin shafts are mounted at the side, so as to reduce frictional force between the cords of the ladder tapes and the turning cylinder 354 after the upper ends of the front and rear cords of the secondary ladder tapes 81, 82 and 83 go in. Two upper ends of the primary ladder tape 80 are directly fixed on the pin shaft 3547, a partition wall 35416 of an inner ring 35420 is set within the turning cylinder 354, a sector hole 35417 is set thereon, one end of the turning cylinder 354 is set with bayonets 35410, 35411 and 35412 and a pin hole 3548 for holding semi-circular notch across the inner wall of the turning cylinder 354 for assembling upper ends of the secondary ladder tape and inserting the pin shaft 3547, and the other end of the turning cylinder 354 is set with bayonets 35413, 35414 and 35415 and a pin hole 35421 for inserting the pin shaft 3546.

Figure 39A:
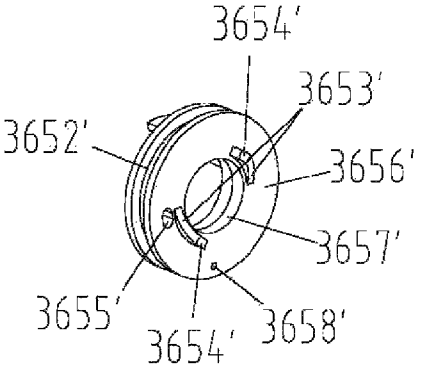
FIG. 39 is a three-dimensional diagram of the second secondary roller of the roller mechanism of the roller system with three secondary louver blades (dual binary pitch).
Figure 39B:
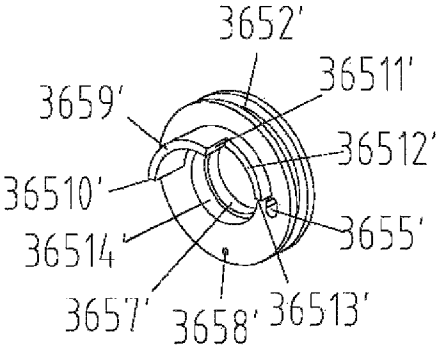

FIG. 39 is a three-dimensional diagram of the turning disc 365'. The turning disc 365' is used as a roller for fixing the second secondary ladder tape 82 in the roller mechanism 35, the cam pin turning mechanism 36' is also used as a turning disc, the structure of the turning disc 365' is substantially the same as that of the turning disc 365, but only an annular groove 3652' is added in the outer ring.

Figure 40A:
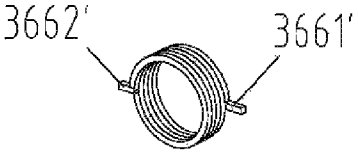
FIG. 40*a* is a three-dimensional diagram of the torsion spring II of the roller mechanism of the roller system with three secondary louver blades (dual binary pitch).
Figure 40B:
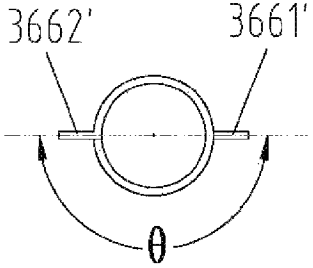
FIG. 40*b* is an axial view of the torsion spring II of the cam pin turning mechanism of the roller system with three secondary louver blades (dual binary pitch).

FIG. 40*a* is a three-dimensional diagram of the torsion spring 366' of the cam pin turning mechanism 36', and FIG. 40*b* is an axial view of the torsion spring 366' of the cam pin turning mechanism 36'. The angle θ between both ends 3661' and 3662' of the torsion spring 366' is dependent on two factors: the angle required when the turning disc 365' drives the second secondary louver blade 92 to rise to the maximum height $D_2$ relative to the primary louver blade 90, and the arc length for ensuring that the high arc wall 3659' of the turning disc 365' has enough strength.

Figure 41A:
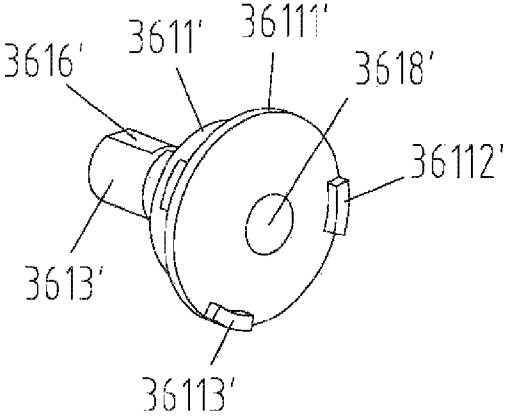
FIG. 41 is a three-dimensional diagram of the fixed sleeve II of the roller mechanism of the roller system with three secondary louver blades (dual binary pitch).
Figure 41B:
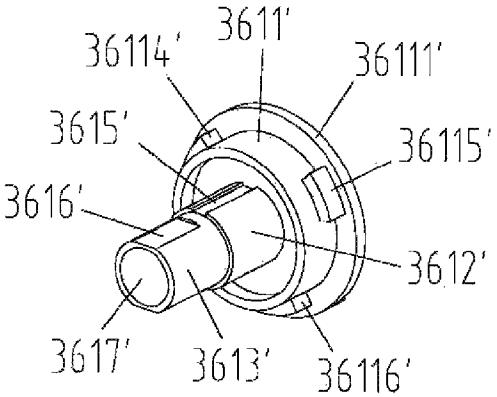

FIG. 41 is a three-dimensional diagram of the fixed sleeve 361' of the cam pin turning mechanism 36'. The structure of the fixed sleeve 361' is substantially the same as that of the fixed sleeve 361 of the cam pin turning mechanism 36, and the difference between the both is that a notch 3616 is set in the outer ring of the annular disc 3611' of the fixed sleeve 361, and an annular disc 36111' with sector bulges 36114', 36115', 36116' and 36112', 36113' on its inner side and outer side is added on the outer end wall of the annular disc 3611' of the fixed sleeve 361'.

FIG. 42 is the assembly drawing of various parts of the roller system, and in the drawing, the turning cylinder 354 is partially sectioned. The turning cylinder 354, the third secondary roller 353, the split wheel 351' of the first secondary roller 351 and the cam pin turning mechanism 36 are sequentially sheathed on the left hollow shaft 3513 of the first secondary roller 351, and then the cam pin turning mechanism 36' is sheathed on the right hollow shaft 3513 of the first secondary roller 351, wherein the inner ring 35312 of the third secondary roller 353 is matched with the axial step 35115 on the left hollow shaft 3513 of the first secondary roller 351 and the sector bulge 3537 of the third secondary roller 353 is embedded into the sector hole 35417 on the partition wall 35416 of the turning cylinder 354, and the inner ring 3513' of the annular convex platform 3512' of the split wheel 351' of the first secondary roller 351 is matched with the axial segment comprising the axial key 35117 on the left hollow shaft 3513 of the first secondary roller 351; the inner ring of the fixed sleeve 361 of the cam pin turning mechanism 36 is matched with the left hollow shaft 3513 of the first secondary roller 351, and sector bulges 36512, 36513 and 36515 on the turning disc 365 of the cam pin turning mechanism 36 are jogged with the notches 35413, 35414 and 35415 on the left end of the turning cylinder, such that the turning disc 365 and the turning cylinder 354 will become one; the inner ring of the fixed sleeve 361' of the cam pin turning mechanism 36' is matched with the axial steps 3515 and 35111 of the right hollow shaft 3513 of the first secondary roller 351, the high and low arc walls 3659' and 36512' of the turning disc 365' are jogged with the annuluses 3516 and 3519 of the first secondary roller 351 to form an intact annular wall, and both ends of the torsion spring 366' and the pin 3636' of the pin disc 363' are located in the joint gap of the intact annular wall, namely, the pin 3636' of the pin disc 363' is inserted into the pin hole 35110 of the first secondary roller 351, one end 3662' of the torsion spring 366' is located between the end wall 36510' of the high arc wall 3659' of the turning disc 365' and the boundary wall 3518 of the annuluses 3516 and 3519 of the first secondary roller 351, and the other end 3661' of the torsion spring 366' and the pin 3636' of the pin disc 363' are located between the end wall 36513' of the low arc wall 36512' of the turning disc 365' and the boundary wall 3517 of the annuluses 3516 and 3519 of the first secondary roller 351 (as shown in FIG. 44*d*), and meanwhile, bulges 36114', 36115' and 36116' on the annular disc 36111' of the fixed sleeve 361' are jogged with the notches 35410, 35411 and 35412 on the end of the turning cylinder 354, such that the fixed sleeve 361' and the turning cylinder 354 become one, thus forming the roller system 3. The rotating shaft of the roller system 3 is a hollow shaft 3513 of the first secondary roller, one of its end is placed on the support 381 of the base 38, and its other end is placed on the support 386, meanwhile, the notch 3616 of the annular disc 3611 of the fixed sleeve 361 is jogged with the bulge 385 of the base 38, thus fixing the fixed sleeve 361 on the base 38, and the neutral position between two sector bulges 36112' and 36113' of the fixed sleeve 361' are directed to the bulge 382 of the base 38, making the turning cylinder 354 rotate within the preset turning angle ϕ range of louver blades.

Figures 42A, 42B:
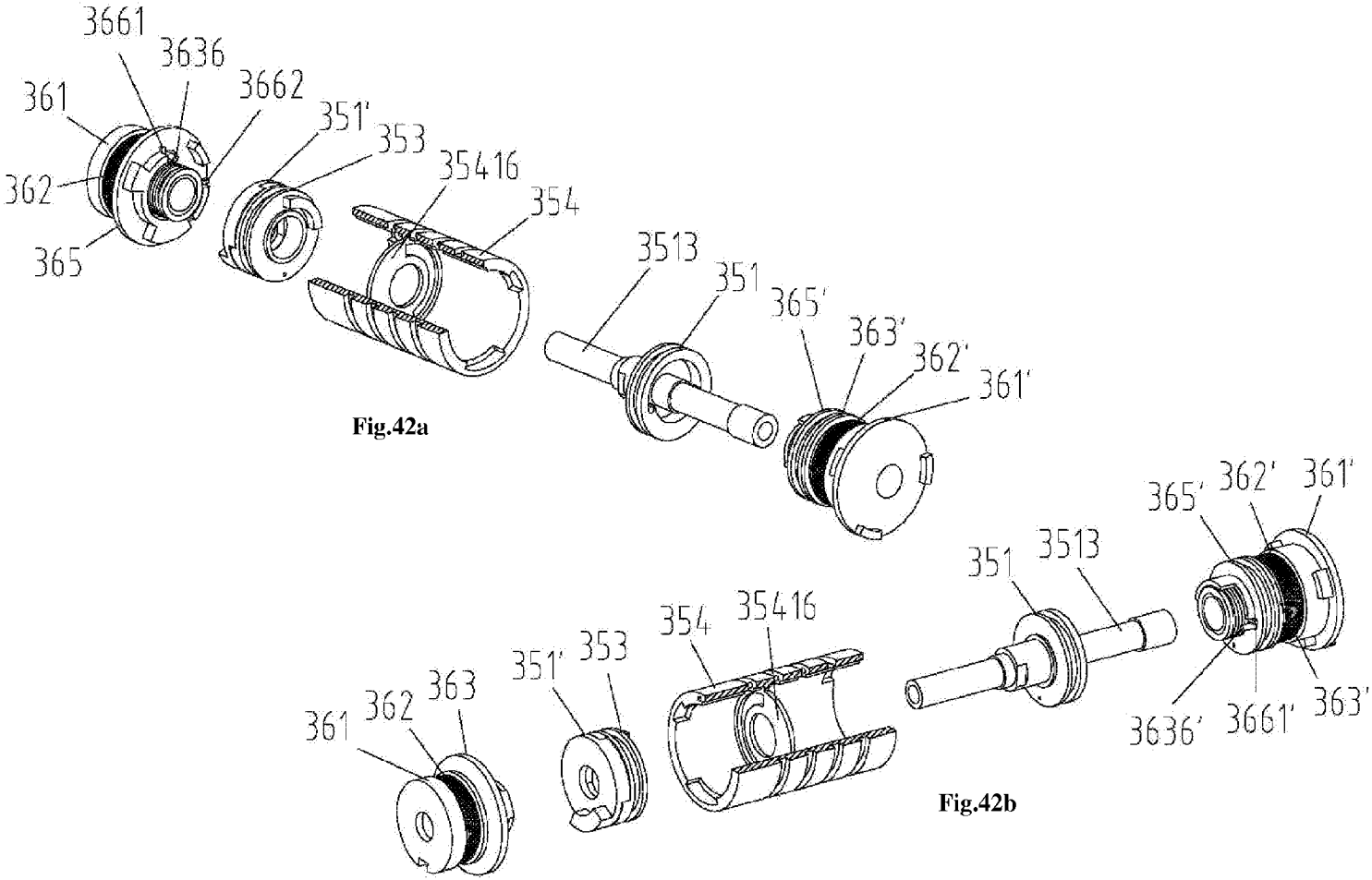
FIG. 42 is a three-dimensional diagram of the assembly relationship of the roller system with three secondary louver blades (dual binary pitch).
Figure 45A:
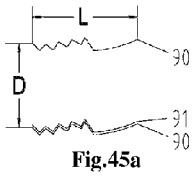
FIG. 45 is a cross-section schematic diagram of a combinatorial louver blade unit of a pitch-variable combinatorial louver with one secondary louver blade in which the secondary louver blade rises and falls relatively, and the primary and secondary louver blades turn over together.
Figure 45B:
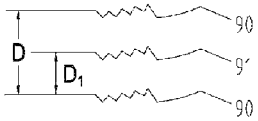
Figure 45C:
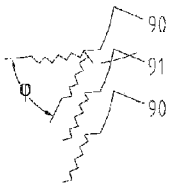
Figure 47A:
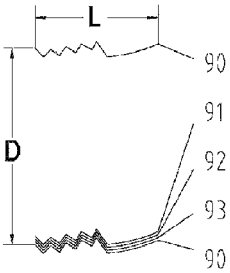
FIG. 47 is a cross-section schematic diagram of a combinatorial louver blade unit of a pitch-variable combinatorial louver with three secondary louver blades in which the secondary louver blades rise and fall relatively, and the primary and secondary louver blades turn over together.

FIG. 44*a* is the A-A sectional view of the initial position where the split wheel 351' of the first secondary roller 351 of the roller system 3 interacts with the turning disc 365 (corresponding to FIG. 47*a*), FIG. 44*b* is the B-B sectional view of the initial position where the first secondary roller 351 of the roller system 3 interacts with the third secondary roller 353 (corresponding to FIG. 47*a*), FIG. 44*c* is the C-C sectional view of the initial position where the third secondary roller 353 of the roller system 3 interacts with the partition wall 35416' of the turning cylinder 354' (corresponding to FIG. 47*a*), FIG. 44*d* is the D-D sectional view of the initial position where the first secondary roller 351 of the roller system 3 interacts with the cam pin turning mechanism 36' and the turning cylinder 354' (corresponding to FIG. 47*a*), and FIG. 44*e* is the E-E sectional view of the initial position where the fixed sleeve 361' of the roller system 3 interacts with the base 38 (corresponding to FIG. 47*a*); when the blade group 9 is at the initial position as shown in FIG. 47*a*, the pin 3636 of the pin disc 363 of the cam pin turning mechanism 36 is inserted into the pin hole 3655 of the turning disc 365 and is flush with the top of the low arc wall 3659 of the turning disc 365, one end 3661 of the torsion spring 366 is held between the pin 3636 and the end wall 36510 of the low arc wall 3659 (as shown in FIG. 42*a* and FIG. 44*a*), and the pin 3636' of the pin disc 363' of the cam pin turning mechanism 36' extends out of the low arc wall 36512' of the turning disc 365' and is inserted into the pin hole 35110 of the first secondary roller 351 (as shown in FIG. 42*b* and FIG. 44*d*).

Figure 47B:
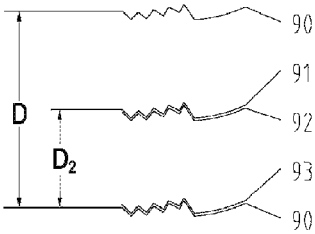
Figure 47C:
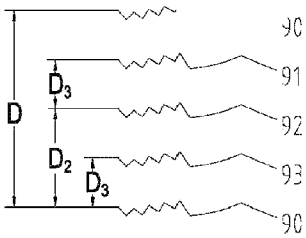
Figure 47D:
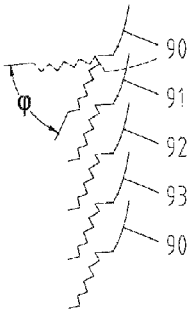

When the hollow shaft 3513 of the first secondary roller 351 is rotated out of the window, namely the hollow shaft 3513 is rotated in the clockwise direction as shown in FIG. 44*a*, FIG. 44*b*, FIG. 44*c* and FIG. 44*e* and in the anti-clockwise direction as shown in FIG. 44*d*, the first secondary roller 351 drives the split wheel 351' to rotate together, meanwhile the pin hole 35110 on the boundary wall 3517 between the annuluses 3516 and 3519 of the first secondary roller 351 presses the pin 3636' of the pin disc 363' of the cam pin turning mechanism 36', and the pin 3636' presses the end wall 36513' of the low arc wall 36512' of the turning disc 365', thus eliminating the effect of locking the turning disc 365' on the fixed sleeve 361' in jogged connection with the turning cylinder 354' by the torsion spring 3636' and pushing the turning disc 365' to rotate in the same direction, until the sector bulge 3517' of the split wheel 351' rotates to the position where its end wall 3518' touches the end wall 3536 of the sector bulge 3534 of the third secondary roller 353 (as shown in FIG. 44*b*). During this rotating process, the front and rear cords 811 and 812 of the first secondary ladder tape 81 of the first secondary louver blade 91 are wound by the first secondary roller 351, and the front and rear cords 821 and 822 of the second secondary ladder tape 82 of the second secondary louver blade 92 are wound by the turning disc 365', such that the first secondary louver blade 91 and the second secondary louver blade 92 leave together from the position where they are superposed with the primary louver blade 90 and horizontally rise an altitude $D_2$ relative to the primary louver blade 90 simultaneously (as shown in FIG. 47*b*); the third secondary roller 353 and the turning cylinder 354 are still, and complete matching of the transition bevel 3643' of the sliding cam 364' of the cam pin turning mechanism 36' with the transition bevel 3653' of the end wall cam of the turning disc 365' is changed into touching of the convex platform 3644 of the sliding cam 3643' with the convex platform 3654' of the end wall cam of the turning disc 365', such that sliding cam 364' pushes the pin disc 363' to slide away from the turning disc 365', resulting in that the pin 3636' of the pin disc 363' is withdrawn from the pin hole 35110 of the first secondary roller 351 to the position where it is flush with the top of the low arc wall 36512' of the turning disc 365', such that while the first secondary roller 351 continues to rotate, the boundary wall 3517 between its annuluses 3516 and 3519 can pass by to touch the boundary wall 36511' between the high and low arc walls of the turning disc 365', thus the turning disc 365' is locked on the fixed sleeve 361' in jogged connection with the turning cylinder 354' without continuously rotating along with the first secondary roller 351. The hollow shaft 3513 of the first secondary roller 351 continues to be rotated, the first secondary roller 351 rotates together with the split wheel 351', and the end wall 3518' of the sector bulge 3517' of the split wheel 351' presses the end wall 3536 of the sector bulge 353 of the third secondary roller 353 so as to push the third secondary roller 353 to rotate together until the end wall 3538 of the sector bulge 3537 of the third secondary roller 353 touches the end wall 35418 of the sector hole 35417 on the partition wall 35416 of the turning cylinder 354 (as shown in FIG. 44*c*), the sector bulge 35110' of the split wheel 351' passes by the pin 3636 of the pin disc 363 until the end wall 35112' of the sector bulge 35110' touches one end 3662 of the torsion spring 366, and the boundary wall 3517 between the annuluses 3516 and 3519 of the first secondary roller 351 touches the boundary wall 36511' between the high and low arc walls of the turning disc 365'. During this rotating process, the second secondary louver blade 92 and the turning cylinder 354 are still, the front and rear cords 811 and 812 of the first secondary ladder tape 81 of the first secondary louver blade 91 are wound by the first secondary roller 351, and the front and rear cords 831 and 832 of the third secondary ladder tape 83 of the third secondary louver blade 93 are wound by the third secondary roller 353, such that the first secondary louver blade 91 leaves from the position where it is superposed with the second secondary louver blade 92, the third secondary louver blade 93 leaves from the position where it is superposed with the primary louver blade 90, and the both horizontally rise an altitude $D_3$ relative to the primary louver blade 90 (as shown in FIG. 47*c*). The hollow shaft 3513 of the first secondary roller 351 continues to be rotated, the first secondary roller 351 drives the split wheel 351', and the split wheel 351' pushes the third secondary roller 353 to rotate together, the end wall 35112' of the sector bulge 35110' of the split wheel 351' presses one end 3662 of the torsion spring 366, and the end 3662 of the torsion spring 366 presses the end wall 3657 of the high arc wall 3656 of the turning disc 365 of the cam pin turning mechanism 36, thus eliminating the effect of locking the turning cylinder 354 on the fixed sleeve 361 by the torsion spring 366 and pushing the turning cylinder 354 and the turning disc 365' to rotate ϕ in the same direction until the side wall of the sector bulge 36112' of the annular disc 36111' of its fixed sleeve 361' jogged and fixed is close to the bulge 382 of the base 38; the front and rear cords 811 and 812 of the first secondary ladder tape 81 of the first secondary louver blade 91 are wound by the first secondary roller 351, the front and rear cords 821 and 822 of the second secondary ladder tape 82 of the second secondary louver blade 92 are wound by the turning disc 365', the front and rear cords 831 and 832 of the third secondary ladder tape 83 of the third secondary louver blade 93 are wound by the third secondary roller 353, and the front and rear cords 801 and 802 of the primary ladder tape of the primary louver blade 90 are wound by the turning cylinder 354, thus they turns ϕ out the window together (as shown in FIG. 47*d*). While the turning cylinder 354 rotates, due to the action of the compression spring 362, the end wall cam of the turning disc 365 gradually moves from the position where its convex platform 3654 touches the convex platform 3644 of the sliding cam 364 to the position where two transition bevels 3653 and 3643 touch and is gradually changed from partial matching to complete matching state, such that the end wall plane 3652 of the turning disc 365 touches the bottom 3646 of the sliding cam 364; the sliding cam 364 can axially slide only because the raised key 3645 in the inner ring is jogged with the notch 3615 of the annular step 3612 of the hollow shaft 3613 of the fixed sleeve 361, as the pin 3636 of the pin disc 363 is inserted in the pin hole 3655 of the turning disc 365, it is driven to rotate by the turning cylinder 354, and meanwhile under the spring pressure of the compression spring 362, the pin disc 363 presses the sliding cam 364 to axially slide together towards the turning disc 365, such that the pin 3636 of the pin disc 363 gradually extends along the end wall 35111' of the sector bulge 35110' of the split wheel 351' (as shown in FIG. 44*a*). After the primary and secondary louver blades 9 turns to the closed position along with the turning cylinder 354, the hollow shaft of the first secondary roller 351 is rotated reversely, then the primary and secondary louver blades 9 are withdrawn in the original order, namely, first the primary and secondary louver blades 9 simultaneously turn to a horizontal position as shown in FIG. 47*c*, while the primary and secondary louver blades 9 turn to the horizontal position, the end wall 35111' of the sector bulge 35110' of the split wheel 351' is pressed against the pin 3636 of the pin disc 363, then the pin 3636 pushes the other end 3661 of the torsion spring 366 to rotate a small angle towards the circumferential direction of the end wall 36510 of the low arc wall 3659 of the turning disc 365, so as to eliminate the effect that the torsion spring 366 locks the turning disc 365 on the fixed sleeve 361, and then the split wheel 351' presses the pin 3636 of the pin disc 363 through the end wall 35111' of its sector bulge 35110', the pin 3636 presses one end 3661 of the torsion spring 366, and the end 3661 of the torsion spring 366 presses the end wall 36510 of the low arc wall 3659 of the turning disc 365, and in such a transmission relation the turning disc 365 together with the turning cylinder 354 is pushed to turn an angle ϕ until the end wall of the sector bulge 36113' of the fixed sleeve 361' jogged with the turning cylinder 354 is blocked by the bulge 382 of the base 38 and it does not rotate any more, thus driving the primary and secondary louver blades 9 through the ladder tape 8 to return from the closed position as shown in FIG. 47*d* to the horizontal position as shown in FIG. 47*c*. During this rotating process, the end wall of the sector bulge 3537 of the third secondary roller 353 is pushed to rotate reversely by the end wall 35418 of the partition wall sector hole 35417 of the turning cylinder 354, the turning disc 365' locked on the turning cylinder 354 rotates reversely along with the turning cylinder 354, and complete matching of the transition bevel 3643 of the sliding cam 364 of the cam pin turning mechanism 36 with the transition bevel 3653 of the end wall cam of the turning disc 365 is changed into touching of the convex platform 3644 of the sliding cam 3643 with the convex platform 3654 of the end wall cam of the turning disc 365, such that sliding cam 364 pushes the pin disc 363 to slide away from the turning disc 365, resulting in that the pin 3636 of the pin disc 363 is withdrawn to the position where it is flush with the top of the low arc wall 3659 of the turning disc 365, such that while the split wheel 351' continues to rotate reversely, its sector bulge 35110' can pass by. The hollow shaft 3513 of the first secondary roller 351 continues to be rotated reversely, the first secondary roller 351 rotates together with the split wheel 351' until the boundary wall 3518 between the annuluses 3516 and 3519 of the first secondary roller 351 touches one end 3662' of the torsion spring 366', meanwhile the split wheel 351' has no reverse push to the third secondary roller 353, but the gravity of the third secondary base rail 103 and the third secondary louver blade 93 delivered by the third secondary ladder tape 83 allows the third secondary roller 353 to rotate reversely, until the end wall 3539 of the sector bulge 3537 of the third secondary roller 353 touches the end wall 35419 of the sector hole 35417 of the partition wall 35416 of the turning cylinder 354 (as shown in FIG. 44*c*). During this reversely rotating process, the second secondary louver blade 92 and the turning cylinder 354 are still, the front and rear cords 811 and 812 of the first secondary ladder tape 81 of the first secondary louver blade 91 are wound off by the first secondary roller 351, and the front and rear cords 831 and 832 of the third secondary ladder tape 83 of the third secondary louver blade 93 are wound off by the third secondary roller 353, such that the first secondary louver blade 91 and the third secondary louver blade 93 fall an altitude $D_3$ relative to the primary louver blade 90, resulting that the first secondary louver blade 91 is superposed on the second secondary louver blade 92, the third secondary louver blade 93 is superposed on the primary louver blade 90 (as shown in FIG. 47*b*). The hollow shaft 3513 of the first secondary roller 351 continues to be rotated reversely, the first secondary roller 351 rotates together with the split wheel 351', the boundary wall 3518 between the annuluses 3516 and 3519 of the first secondary roller 351 pushes one end 3662' of the torsion spring 366', and the end 3662' of the torsion spring 366' presses the end wall 36510' of the high arc wall 36519' of the turning disc 351, thus eliminating the effect of locking the turning disc 365' on the fixed sleeve 361' by the torsion spring 366' and pushing the turning disc to rotate reversely until the end wall 3519' of the sector bulge 3517' of the split wheel 351' touches the end wall 353 of the sector bulge 3534 of the third secondary roller 353 (as shown in FIGS. 44*b* and 44*d*); the turning disc 365' rotates relative to the turning cylinder 354, touching of the convex platform 3644 of the sliding cam 364 of the cam pin turning mechanism 36' with the convex platform 3654' of the side wall cam of the turning disc 365' is changed into complete matching of the transition bevel 3643 of the sliding cam 364 with the transition bevel 3653' of the side wall cam of turning disc 365', such that the pin disc 363' slide towards the turning disc 365' under the action of spring pressure of the compression spring 362', resulting that the pin 3636' of the pin disc 363' is inserted into the pin hole 35110 on the boundary wall 3517 between the annuluses 3516 and 3519 of the first secondary roller 351 and gradually extends further (as shown in FIG. 44*d*). During this reversely rotating process, the front and rear cords 811 and 812 of the first secondary ladder tape 81 of the first secondary louver blade 91 are wound off by the first secondary roller 351, and the front and rear cords 821 and 822 of the second secondary ladder tape 82 of the second secondary louver blade 92 are wound off by the turning disc 365', such that the first secondary louver blade 91 and the second secondary louver blade 92 horizontally fall an altitude $D_2$ relative to the primary louver blade 90, resulting that the first secondary louver blade 91 and the second secondary louver blade 92 are superposed on the primary louver blade 90 (as shown in FIG. 47*a*).

The internal relationship of the roller system 3 for the pitch-variable combinatorial louver with three secondary louver blades (dual binary pitch) is dependent on relative lifting heights $D_2$ and $D_3$ and turning closed angle $\phi$ of the primary and secondary louver blades 9, and its design principles are consistent with Examples 1, 2 and 3.

Figure 48A:
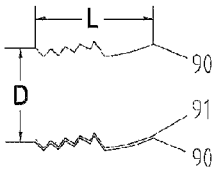
FIG. 48 is a cross-section schematic diagram of a combinatorial louver blade unit of a pitch-variable combinatorial louver with one secondary louver blade in which the secondary louver blade rises and falls relatively, and turns over, but the primary louver blade does not turn over.
Figure 48B:
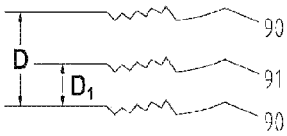
Figure 48C:
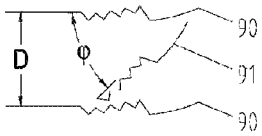
Figure 49A:
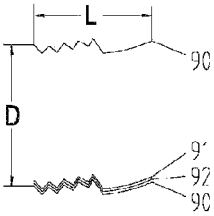
FIG. 49 is a cross-section schematic diagram of a combinatorial louver blade unit of a pitch-variable combinatorial louver with two secondary louver blades in which the secondary louver blades rise and fall relatively, and turn over, but the primary louver blade does not turn over.
Figure 49B:
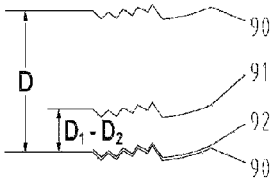
Figure 49C:
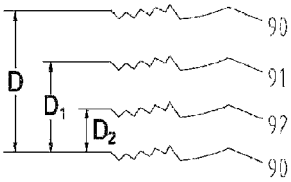
Figure 49D:
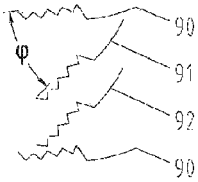
Figure 50A:
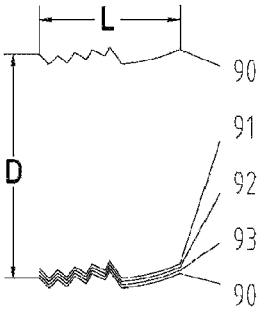
FIG. 50 is a cross-section schematic diagram of a combinatorial louver blade unit of a pitch-variable combinatorial louver with three secondary louver blades in which the secondary louver blades rise and fall relatively, and turn over, but the primary louver blade does not turn over.
Figure 50B:
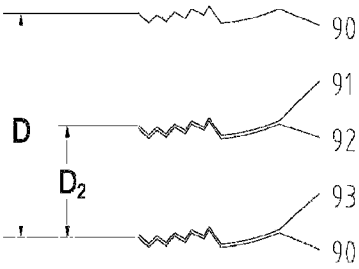
Figure 50C:
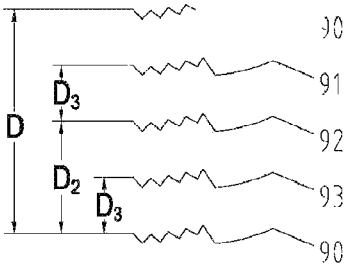
Figure 50D:
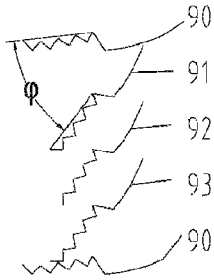

In the roller system described above, only if the upper end of the primary ladder tape 80 fixed in the annular groove 3544 of the turning cylinder 354 is changed to be fixed on the top rail 1, it can be applied to the roller system of the pitch-variable combinatorial louver with one secondary louver blade (as shown in FIG. 48), the roller system of the pitch-variable combinatorial louver with two secondary louver blades (as shown in FIG. 49) and the roller system of the pitch-variable combinatorial louver with three secondary louver blades (as shown in FIG. 50).

The principles of the roller system described above can also be extended to the pitch-variable combinatorial louver with more than four secondary louver blades.

In a word, the foregoing is preferred examples of the invention only, and equivalent changes and modifications made according to the application scope of the invention should be encompassed within the scope of the invention.

What is claimed is:

1. A louver roller system with a cam pin turning mechanism, comprising a base (38) and a top cover (39), wherein: a roller mechanism (35) and a cam pin turning mechanism (36) are mounted on the base (38), the roller mechanism (35) is coaxially aligned with the cam pin turning mechanism (36), rotation of the roller mechanism (35) and the cam pin turning mechanism (36) is driven by a square shaft (2), there is a roller within the roller mechanism (35), the roller mechanism (35) comprises a turning cylinder (354), at least one roller is mounted within the turning cylinder (354), the roller is wound with ladder tapes and the ladder tapes are connected with louver blades, the roller drives the ladder tapes to wind or unwind while rotating, the cam pin turning mechanism (36) comprises a turning disc (365) and the turning disc (365) of the cam pin turning mechanism (36) is connected to an open end surface of the turning cylinder (354), a torsion spring (366) is placed within one end of the turning disc (365) and fasten onto a torsion spring jacket (367), the torsion spring jacket (367) is adjacent to the roller, and a fixed sleeve (361), a compression spring (362), a pin disc (363) and a sliding cam (364) are sequentially coaxially aligned with the turning disc (365).

2. A louver roller system with a cam pin turning mechanism, comprising a base (38) and a top cover (39), wherein: a roller mechanism (35) and two sets of cam pin turning mechanism (36, 36') are mounted on the base (38), each set of the cam pin turning mechanism (36, 36') is coaxially aligned with one side of the roller mechanism (35), rotation of the roller mechanism (35) and the two sets of cam pin turning mechanism (36, 36') is driven by a square shaft (2), the roller mechanism (35) comprises a turning cylinder (354), a first secondary roller (351) is mounted within the turning cylinder (354), a third secondary roller (353), a split wheel (351'), a torsion spring jacket (367), a torsion spring (366), a turning disc (365), a sliding cam (364), a pin disc (363), a compression spring (362) and a fixed sleeve (361) are sequentially coaxially aligned with one side of the first secondary roller (351), and a torsion spring jacket (367'), a torsion spring (366'), a turning disc (365'), a sliding cam (364'), a pin disc (363'), a compression spring (362') and a fixed sleeve (361') are sequentially coaxially aligned with the other side of the first secondary roller (351), after the first secondary roller (351), the split wheel (351') and the turning disc (365') rotate synchronously to drive a first secondary louver blade and a second secondary louver blade to rise a certain distance $D_2$ synchronously and horizontally, the turning disc (365') is detached from the first secondary roller (351) through the cant pin turning mechanism (36') and then the first secondary roller (351) drives the third secondary roller (353) to rotate, making the first secondary louver blade and a third secondary louver blade to rise synchronously and horizontally, and after rising $D_3$, rotation of the turning disc (364) and the turning cylinder (354) is driven by the cam pin turning mechanism (36).

3. The louver roller system with a cant pin turning mechanism according to claim 1, wherein: the turning cylinder (354) is a circular cylinder of which one end is a closed end surface and the other end is an open end surface, annular grooves are set on an outer ring surface of the turning cylinder (354), a hole (3545) is set on the top of each of the annular grooves (3541, 3542 and 3544) and pin shafts (3546) are mounted on both sides of the holes, sector bulges (3549 and 35411) extend coaxially from an outer wall of the closed end surface of the turning cylinder (354) for controlling rotation angle of the turning cylinder (354), such that when turning cylinder (354) rotates to its sector bulges and touches a base bulge (382), it does not continue to rotate any more, and when the turning cylinder (354) rotates reversely, an annular bulge (35416) extending coaxially from an inner wall of the closed end surface of the turning cylinder (354) acts on a second secondary roller (352), such that the second secondary roller (352) rotates reversely to drive second secondary louver blade to return to a horizontal position.

4. The louver roller system with a cam pin turning mechanism according to claim 2, wherein: the turning cylinder (354) is a circular cylinder, there is a partition wall (35416) within the turning cylinder (354) and annular grooves (3541, 3542 and 3544) are set on its outer ring surface, a hole (3545) is set on the top of each of the annular grooves (3541, 3542 and 3544) and pin shafts (3546) are mounted on both sides of the holes, a hole is set on the tap of the annular groove (3544) for fixing the pin shaft (3547), an inner ring (35420) and a sector inner hole (35417) are placed on the partition wall (35416) of the turning cylinder (354), and when the turning cylinder (354) rotates reversely, the partition wall (35416) acts on the third secondary roller (353), such that the third secondary roller (353) rotates reversely to drive the third secondary louver blade (93) to return to a horizontal position.

5. The louver roller system with a cam pin turning mechanism according to claim 1, wherein: the first secondary roller (351) comprises an annular disc (3511) and a hollow shaft (3513), an annular groove (3512) is set in the center of the annular disc (3511), and sector bulges (3515 and 35110) extend coaxially from both sides of the annular disc (3511).

6. The louver roller system with a cam pin turning mechanism according to claim 1, wherein: the second secondary roller (352) comprises an annular disc (3521), an annular groove (3522) is set on the annular disc (3521), a sector bulge (3524) extends coaxially from one side of the annular disc (3521) adjacent to the first secondary roller (351), and an annular convex platform (35210) with a sector bulge (3527) extends coaxially from the other side of the annular disc (3521).

7. The louver roller system with a cam pin turning mechanism according to claim 2, wherein: the third secondary roller (353) comprises an annular disc (3531), an annular groove (3532) is set on the annular disc (3531), a sector bulge (3534) extends coaxially from one side of the annular disc (3531) adjacent to the first secondary roller (351), and an annular convex platform (35310) with a sector bulge (3537) extends coaxially from the other side of the annular disc (3531).

8. The louver roller system with a cam pin turning mechanism according to claim 1, wherein: an annular concave disc is set on one side of the turning disc (365), a high arc wall (3656) and a low arc wall (3659) which are step-like are set in the annular concave disc, a pin hole (3655) is set near an end wall (36510) of the low arc wall (3659), a torsion spring (366) is mounted inside of the high arc wall (3656) and the low arc wall (3659), both ends of the torsion spring (366) are set on the end walls (3657 and 36510) of the high arc wall (3656) and the low arc wall (3659), a convex platform (3654) with a transition bevel (3653) is set on the other side of the turning disc (365), and the convex platform (3654) and the sliding cam (364) fit together.

9. The louver roller system with a cam pin turning mechanism according to claim 2, wherein: an annular concave disc is set on one side of the turning disc (365'), a high arc wall (3656') and a low arc wall (3659') which are step-like are set in the annular concave disc, a pin hole (3655') is set near an end wall (36510') of the low arc wall (3659), a torsion spring (366') is mounted inside of the high arc wall (3656') and the low arc wall (3659'), both ends of the torsion spring (366') are set on the end walls (3657' and 36510') of the high arc wall (3656') and the low arc wall (3659'), a convex platform (3654') with a transition bevel (3653') is set on the other side of the turning disc (365'), the convex platform (3654') and the sliding cam (364') fit together, and an annular groove (3652') is set in the outer ring of the turning disc (365').

10. The louver roller system with a cam pin turning mechanism according to claim 1, wherein: a pin (3636) is set on the pin disc (363), a sliding cam (364) is set within the pin disc (363), and a compression spring (362) is mounted between the pin disc (363) and the fixed sleeve (361).

11. The louver roller system with a cam pin turning mechanism according to claim 1, wherein: a pair of raised keys (3645) are set on an inner ring wall of the annular disc of the sliding cam (364), a bulge (3644) and a transition bevel (3643) are set on the side of the sliding cam (364), and the bulge (3644) and the transition bevel (3643) and the convex platform (3654) of the turning disc (365) fit together.

12. The louver roller system with a cam pin turning mechanism according to claim 2, wherein: the first secondary roller (351) comprises an annular disc (3511) and a hollow shaft (3513), an annular groove (3512) is set in the center of the annular disc (3511), and sector bulges (3515 and 35110) extend coaxially from both sides of the annular disc (3511).

13. The louver roller system with a cam pin turning mechanism according to claim 2, wherein: a pin (3636) is set on the pin disc (363), a sliding cam (364) is set within the pin disc (363), and a compression spring (362) is mounted between the pin disc (363) and the fixed sleeve (361).

14. The louver roller system with a cam pin turning mechanism according to claim 2, wherein: a pair of raised keys (3645) are set on an inner ring wall of the annular disc of the sliding cam (364), a bulge (3644) and a transition bevel (3643) are set on the side of the sliding cam (364), and the bulge (3644) and the transition bevel (3643) and the convex platform (3654) of the turning disc (365) fit together.

* * * * *